US010861427B2

(12) United States Patent
Lupini et al.

(10) Patent No.: US 10,861,427 B2
(45) Date of Patent: Dec. 8, 2020

(54) DEVICE CONFIGURATIONS AND METHODS FOR GENERATING DRUM PATTERNS

(71) Applicant: Harman International Industries, Incorporated, Stamford, CT (US)

(72) Inventors: Peter R. Lupini, Victoria (CA); Glen A. Rutledge, Brentwood Bay (CA); Norm Campbell, Delta (CA); Daniel Godlovitch, Victoria (CA)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/030,100

(22) Filed: Jul. 9, 2018

(65) Prior Publication Data

US 2019/0012995 A1 Jan. 10, 2019

Related U.S. Application Data

(60) Provisional application No. 62/530,818, filed on Jul. 10, 2017.

(51) Int. Cl.

| | |
|---|---|
| ***G10H 1/40*** | (2006.01) |
| ***G10H 1/00*** | (2006.01) |
| ***G10D 13/02*** | (2020.01) |
| ***G10H 1/42*** | (2006.01) |

(52) U.S. Cl.

CPC ..... *G10H 1/0008* (2013.01); *G10D 13/029* (2013.01); *G10H 1/40* (2013.01); *G10H 1/42* (2013.01); *G10H 2210/071* (2013.01); *G10H 2210/076* (2013.01); *G10H 2210/356* (2013.01)

(58) Field of Classification Search

CPC ..... G10H 1/40; G10H 2250/641; G10H 2210/071; G10H 2210/341; G10H 2230/285; G10D 13/024; G10D 13/02

See application file for complete search history.

(56) References Cited

U.S. PATENT DOCUMENTS

| | | | | |
|---|---|---|---|---|
| 8,183,451 | B1 * | 5/2012 | Panaiotis | G10H 1/0025 84/601 |
| 2009/0287323 | A1 * | 11/2009 | Kobayashi | G10H 1/0008 700/94 |
| 2011/0239847 | A1 * | 10/2011 | Small | G10H 1/0083 84/723 |

(Continued)

*Primary Examiner* — Marlon T Fletcher

(74) *Attorney, Agent, or Firm* — Gordon & Rees LLP

(57) ABSTRACT

The present disclosure relates to methods and devices for generating drum patterns. In one embodiment a method includes receiving a user generated input including a plurality of events during a time interval, and detecting the events. The method also includes analyzing the events to define a rhythmic pattern based on number of events detected, placement of each event in the time interval, and duration of the time interval. Each of the plurality of events may be classified into at least one type of drum pattern element and a drum pattern may be generated based on the rhythmic pattern to include a drum element for each event of the rhythmic pattern. In certain embodiments, pitch or tone of the events may be determined to classify events as components of a drum pattern. Processes and devices allow for professional sounding drum patterns to be output based on received input.

20 Claims, 8 Drawing Sheets

(56) References Cited

U.S. PATENT DOCUMENTS

2012/0192701 A1* 8/2012 Watanabe ..... G10H 1/40
84/622
2013/0152768 A1* 6/2013 Rapp ..... G10H 3/125
84/634

* cited by examiner

DEVICE CONFIGURATIONS AND METHODS FOR GENERATING DRUM PATTERNS

CROSS-REFERENCE TO RELATES APPLICATIONS

This application claims priority to U.S. Provisional Patent Application No. 62/530,818 titled DEVICE CONFIGURATIONS AND METHODS FOR GENERATING DRUM PATTERNS filed on Jul. 10, 2017, the content of which is expressly incorporated by reference in its entirety.

FIELD

The present disclosure relates to devices and methods for generating rhythmic patterns, and more particularly to processes and configurations for producing drum patterns from at least one of audio and non-audio input.

BACKGROUND

Musicians often desire backing music, such as an accompanying drum beat when performing or practicing music. In modern music, drum beats often compliment a multiple music styles and may be tailored to music type or particular songs. Drum machines and prerecorded tracks are one way to provide an accompanying track without having to have another musician perform. However, existing forms of providing accompanying music, such as drum machines and drum playback devices, have several drawbacks. A typical drum machine will play a drum loop pattern consisting of prerecorded drum sounds. Many users find existing drum machines either too limiting or exceedingly difficult to operate, especially when a desired drum pattern cannot be programmed. Often, pre-recorded drum patterns do not provide a desired drum pattern. In addition, existing systems are not user friendly. Even seasoned musicians desire improved functionality of existing drum machines.

There exists a need for other methods of conveying desired drum patterns, other than conventional operation of drum machines or selection of prerecorded drum patterns from track listings. Many users find it difficult to use the existing tools to create a desired drum beat due to timing error or lack of skill. User created drum beats may be rhythmically awkward due to machine delay or user ability. With existing methods, users are often beholden to the key pads for input of a drum machine or pre-recorded drum patterns. In addition, control or operation of the drum machine while playing a musical instrument is often difficult.

BRIEF SUMMARY OF THE EMBODIMENTS

Disclosed and claimed herein are methods and devices for generating drum patterns. One embodiment is directed to a method including receiving a user generated input including a plurality of events during a time interval. The method also includes detecting the plurality of events in the user generated input. The method also includes analyzing the plurality of events to define a rhythmic pattern based on number of events detected, placement of each event in the time interval, and duration of the time interval. Analyzing includes classifying each of the plurality of events into at least one type of drum pattern element. The method also includes generating a drum pattern based on the rhythmic pattern, wherein the drum pattern includes a drum element for each event of the rhythmic pattern.

In one embodiment, the user generated input is an audio signal received from at least one of a musical instrument and microphone, the audio signal indicating a desired groove for the drum pattern.

In one embodiment, the user generated input is a percussive beat tapped as input to a device, the percussive beat indicating a desired groove for the drum pattern.

In one embodiment, detecting the plurality of events includes detecting at least one feature for each event from an audio input signal received as the user generated input.

In one embodiment, detecting the plurality of events includes detecting an input activation of a device for each event, wherein the input activation is relative to at least one input control element of the device.

In one embodiment, analyzing includes determining a number of bars, time signature and feel for the rhythmic pattern.

In one embodiment, classifying each of the plurality of events into at least one type of drum pattern element includes classifying each event as one of a kick drum element and snare drum element.

In one embodiment, the rhythmic pattern provides an arrangement of drum beats relative to a determined number of bars, determined time signature and determined feel for the plurality of events.

In one embodiment, the method further includes outputting the drum pattern, wherein outputting includes at least one of outputting audio sounds for the drum pattern, storing the drum pattern, and outputting a display for the drum pattern.

In one embodiment, the method further includes outputting a sound element for each detected event, wherein the sound element is output within a time period in the range of about 10-30 milliseconds from detection of the event.

In one embodiment, the method further includes determining event placement with respect to a beat characterization of the time interval and beat subdivisions.

In one embodiment, the method further includes generating the drum pattern based on a plurality of drum pattern styles and a plurality of time signatures.

In one embodiment, the method further includes performing a first classification of each event of the plurality of events within a first latency period to generate a sound response to detection of an event and performing a second classification of each event of the plurality of events within a second latency period for determination of the rhythmic pattern.

In one embodiment, the first latency period is within a time period of about 10-30 milliseconds and the second latency period is within the time period of about 30-60 milliseconds.

Another embodiment is directed to a device including an input configured to receive user generated input, and a control unit coupled to the input. The control unit is configured to receive user generated input including a plurality of events during a time interval, and detect the plurality of events in the user generated input. The control unit is also configured to analyze the plurality of events to define a rhythmic pattern based on number of events detected, placement of each event in the time interval, and duration of the time interval. Analyzing includes classifying each of the plurality of events into at least one type of drum pattern element. The control unit is also configured to generate a drum pattern based on the rhythmic pattern, wherein the drum pattern includes a drum element for each event of the rhythmic pattern.

Another embodiment is directed to a method for generating drum pattern, including detecting, by a device, a command to begin a learning state, and receiving, by the device, an input including a plurality of events. The method also includes detecting, by the device, a command to end the learning state, and detecting, by the device, the plurality of events from the input. The method also includes analyzing, by the device, the plurality of events to define a rhythmic pattern based on number of events detected, placement of each event in the time interval, and duration of the time interval. Analyzing includes classifying each of the plurality of events into at least one type of drum pattern element. The method also includes generating, by the device, a drum pattern based on the rhythmic pattern, wherein the drum pattern includes a drum element for each event of the rhythmic pattern.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 2:
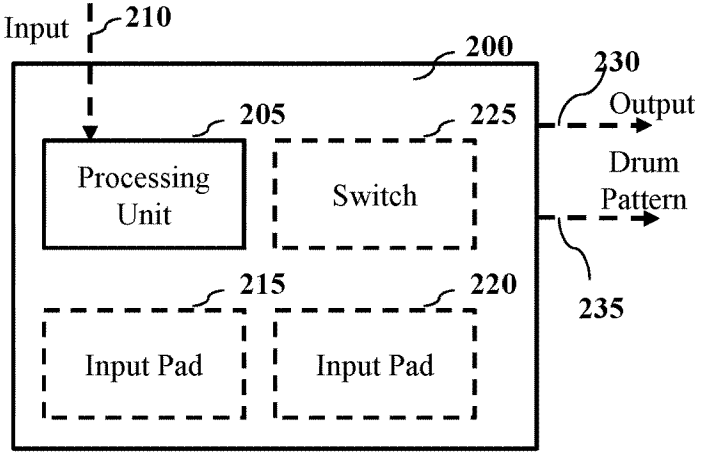
FIG. 2 depicts a graphical representation of a device for generating a drum pattern according to one or more embodiments of the present disclosure.

One aspect of the disclosure is directed to generating drum patterns. Processes and device configurations are described that serve both professional and amateur musicians who wish to create a specific drum pattern for either practicing or performing. Many people find it easy to tap out a beat, for example, tapping on a table top with their hands or singing a drum pattern using vocalizations representative of desired drum sounds. In other cases, musicians desire the ability to generate a desired beat using a musical instrument, such as a guitar, as an input source. Processes and device configurations are provided to detect natural expressions of drum patterns as input and convert the input into an actual drum pattern. The processes and configurations described herein are directed to overcoming difficulties associated with creating a drum pattern. Developments are provided that can overcome the difficulties of existing devices which are above the technical ability of many users. In addition, the processes and configurations are provided that overcome the limitations of systems which require a user to select a prerecorded drum track from a listing of drum tracks.

Processes and device configurations described herein allow for a user to go from an idea to a full drum pattern in a very short amount of time using an intuitive and natural approach. Processes and device configurations are configured to detect user generated input provided as a desired main groove (for example, kick/snare pattern), and to generate a drum pattern built upon the main groove to create a full drum pattern which incorporates the rhythmic input provided by a user. In addition, by allowing the user to input their own kick/snare part of a drum beat, the user can come up with unique patterns that may not even be on a list of predefined patterns of traditional drum machines. As such, processes and device configurations described herein allow for the benefits of having a drum pattern accompany playing without the frustration of locating a desired drum pattern.

As described herein input may relate to audio input signals and non-audio input. In one embodiment, input relates to an audio signal which may be generated by musical instrument (e.g., electric guitar, electric bass guitar, etc.) or audio source, such as a microphone. The input signal may be provided to a device by way of a cable from the musical instrument or microphone. According to another embodiment, input may be non-audio input provided by way of one or more input sources of a device, such as device pads.

A drum pattern relates to a combination of sounds from multiple sources of a drum kit. Generating a drum pattern may include defining an output pattern of multiple drum sounds for a time interval, wherein at least one of the drum sound type, timing, and style may be stored or output by a device. By way of example, a rock drum pattern may include kick drum and snare events on certain beats, and cymbal or percussion events throughout the drum beat. Drum patterns may be played straight or with a swing tempo. In addition, drum patterns may be associated with different time signatures. Devices and processes described herein allow for generation of drum patterns based on received input and drum sounds for multiple components of a drum kit. By way of example, a device may store a plurality of drum sounds (e.g., kick drum sound, snare drum sound, hi-hat open sound, hi-hat closed, etc.) for multiple drum kit styles. Stored sounds may be applied to a generated drum pattern and output such that the drum pattern may be played by itself and/or to accompany another instrument or source.

A rhythmic pattern may relate to a characteristic beat or identifying characteristic of a drum pattern. By way of example, a modern rock drum pattern can include playing kick drum on particular beats of a measure, and playing a snare drum on certain beats. Rock beats may have varying tempo, and are typically categorized with "on beat" placement to provide a straight even feel. Alternatively, a swing beat usually has a triplet feel at slower tempos, wherein beat placement is manipulated for effect. A funk groove is often played with a wide dynamic range, open hi-hats and unusual snare placement. Devices and processes described herein can account for a plurality of rhythmic patterns, based on beat placement, tempo, and timing (e.g., bar length, beat length, number of beats, etc.).

Devices and processes described herein may operate for multiple styles of music (e.g., Rock, Blues, Pop, Jazz, etc.). Accordingly, generating drum patterns can include producing drum patterns for multiple time signatures (e.g., 4/4, 3/4, 5/4, 7/4, etc.). In addition, drum patterns can be generated with respect to a desired feel (e.g., straight, $8^{th}$ note swing, $16^{th}$ note swing, etc.).

One embodiment is directed to processes for generating a drum pattern from user generated input. Input may be generated by a user, the input including a plurality of events to signify a desired groove. The inputs may be based on the type of input. The input may be received during a time interval, such that the time interval and input signify a desired rhythmic pattern (e.g., groove, kick/snare combination, etc.) and length of the pattern. The process can include detecting a plurality of events from the input and analyzing the events to define a rhythmic pattern. According to one embodiment, number of events detected, placement of each event in the time interval, and duration of the time interval may be analyzed to characterize the input into a rhythmic pattern. Analyzing can include classifying each event of the input into a drum pattern element, such as a kick drum hit or snare drum hit. The process can also include generating a drum pattern based on the rhythmic pattern. The drum pattern includes a drum element for each event of the rhythmic pattern, and can include one or more additional elements to be applied based on analysis of the input. By way of example, the drum pattern can include kick and snare components based on the input with an $8^{th}$ note hi-hat beat added to the kick and snare pattern. Feel (e.g., straight or swing) of the drum pattern may be determined as well as an embellishment level when generating the drum pattern. By way of example, the drum pattern generated may be an $8^{th}$ note rock pattern played straight in some cases.

Another aspect of the disclosure is directed analysis of input for generating a drum pattern. One or more processes allow for user generated input to be transformed based on analysis of the input into a drum pattern. In one embodiment, a classification process is provided to aid in classification of input and events. The classification process provides a level of feel that is responsive while also providing an accurate classification and interpretation of input. In one embodiment a two stage classification process is provided including a low latency first classification employed to output a sound element as feedback and a second stage of classification with a longer latency that results in a much lower error rate.

Another aspect of the disclosure is directed to enhancing drum pattern generation by providing a level of embellishments to be added to rhythmic patterns detected in input. An embellishment range may be provided that includes adding elements to a main groove that result in a drum pattern that sounds more like it was played by a real drummer. Drum patterns may be enhanced by providing embellishments to generated patterns, wherein the amount of embellishment may be controlled.

Another aspect of the disclosure is directed to providing an effects unit or module that may be controlled and operated by a user to allow for drum pattern generation. In one embodiment, device configurations are provided for individual units, such as effects pedals, and control interfaces, such as digital workstations configured to receive input and generate drum patterns. The device configurations may include one or more of learning states and playback states that allow for both generating a drum pattern and control of how the drum pattern is played.

Another aspect of the disclosure is control and playback of drum patterns, such as an accompanying drum pattern. Device configurations and processes described herein allow for operation of a device including a push button switch and one or more lighted indicators, such as LEDs, to enter into and change out of several operation states. By way of example, the device can allow for entering into a learning state to generate one or more drum patterns. Alternatively, a song playback state may be entered into for playback of one or more previously generated drum patterns (e.g., drum patterns generated by a user). In addition, one or more parts of the song may be played (e.g., verse, chorus, outro, etc.). In addition, one or more parts of a song, or the song in its entirety, may be deleted using the device, including but not limited to footswitch control for deletion. According to another embodiment, processes and device configurations include providing operational states or modes to allow the device to learn a desired input pattern and output a drum pattern. In addition, operational states may include the ability to create a song, play parts of a song (e.g., intro, verse, chorus, fill, outro, etc.). In yet another embodiment, parts of a song may be stored on a device to allow for playback. In addition, song parts or songs as a whole may be deleted or cleared from memory.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

EXEMPLARY EMBODIMENTS

Figure 1:
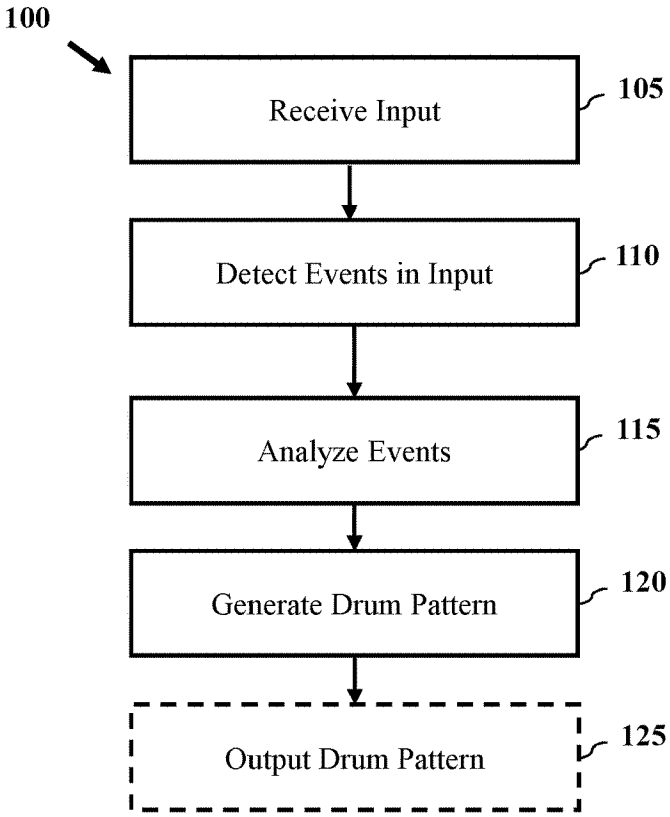
FIG. 1 depicts a process for generating a drum pattern according to one or more embodiments.

Referring now to the figures, FIG. 1 depicts a process for generating a drum pattern according to one or more embodiments. Process 100 may be employed to allow a user to go from an idea to a full drum pattern in a very short amount of time using an intuitive and natural approach. Process 100 allows for multiple types of input, including but not limited to tapping of a desired beat or use of a musical instrument, to express drum patterns. As will be described herein, process 100 may be performed by a device or module/component of a device. In addition, process 100 may be modified to include additional, or in some cases different, operations in order to generate and/or output drum patterns.

In one embodiment, process 100 may be initiated by receiving input at block 105. According to one embodiment, input received at block 105 is user generated input provided as a desired groove pattern (e.g., main groove pattern) for generating a drum pattern. As will be described below, the rest of drum pattern may be built upon groove pattern received as input. In certain embodiments, the input is provided as an indication of a desired kick drum component and snare drum component (e.g., kick/snare pattern) for a desired drum pattern. The input at block 105 may be provided as a basis for process 100 to create a full drum pattern which is very close to, and/or that incorporates, the rhythmic elements provided by the input. By allowing the user to input their own kick/snare pattern as input, unique patterns may be generated that are not provided by predefined patterns or listings of drum patterns on traditional drum machines.

According to one embodiment, input received at block 105 may relate to at least one of audio input and non-audio input. In one embodiment, input received at block 105 relates to an audio input signal received from a musical instrument, which may include muted strums on a guitar, taps on a ukulele body, vocal sounds, etc. Input received at block 105 may be a user generated audio signal received from at least one of a musical instrument and microphone. The audio signal indicates a desired groove for the drum pattern. The audio signal may be generated by a user to represent a desired groove pattern that feels natural to a non-drummer, such as a pattern representative of a kick/snare pattern in a drum track. Examples of different types of input may be strumming the low and high strings on a muted guitar, making a low and high frequency percussive vocal sound. In one embodiment, the timing of the input is representative of a users desired groove, and the duration of the input may be employed to characterize a rhythmic pattern input by a user.

According to another embodiment, input received at block 105 is non-audio input. By way of example, in some embodiments the input may be generated using one or more input pads of a device. The user generated input may include pad hits. By way of further example, the input is a percussive beat tapped as input to a device. The percussive beat can indicate a desired groove for a drum pattern. In certain embodiments, two pads are utilized, one for a kick drum and another for a snare drum.

In certain embodiments, receiving input at block 105 ends in response to a user command marking the end of a time interval, such as a control command or footswitch control. During the time interval for receiving input, a plurality of events may be received during a time interval at block 105. Input at block 105 is then analyzed to extract events and classify them.

At block 110, process 100 includes detecting events in input. Process 100 may include one or more methods for event detection at block 110. Exemplary methods for detecting events include, but are not limited to, event detection methods described by Scheirer, E. (1998) "Tempo and Beat Analysis of Acoustic Musical Signals," JASA, 103,2801X, and, Spectral vs Spectro-Temporal Features for Acoustic Event Detection, by Cotton and Ellis, 2011 IEEE Workshop on Applications of Signal Processing to Audio and Acoustics, Oct. 16-19, 2011, New Paltz, N.Y.)

Process 100 can detect a plurality of events from the user generated input. When the input relates to an audio signal, detecting the plurality of events includes detecting at least one feature at block 110 for each event from an audio input signal received as the user generated input. Process 100 may include detecting at least one feature for each event in the audio input signal. By way of example, the events may be detected and analyzed with respect to a plurality of frequency bands such that at least one of the bands includes a response, such as a signal peak multiple peaks. As such, features may be detected and analyzed for each event relative to the plurality of frequency bands. When the input relates to use of input pads, detecting the plurality of events at block 110 includes detecting input activation of a device for each event. Each input activation is relative to at least one input control element of the device, such that input taps may be entered to a first pad for a kick drum component and input taps may be entered to a second pad for a snare drum component. Multiple input pad hits may be detected at the same time, at block 110.

At block 115, process 100 includes analyzing events of the input. In one embodiment, a plurality of events are analyzed to define a rhythmic pattern based on number of events detected, placement of each event in the time interval, and duration of the time interval. Analyzing at block 115 can include classifying each of the plurality of events into at least one type of drum pattern element. For example, classifying each of the plurality of events at block 115 can include classification into at least one type of a kick drum element and snare drum element.

Analysis at block 115 can determine a rhythmic pattern characterizing the input received at block 105. Analysis of the events at block 115 allows for determining the number of bars, timing (3/4, 4/4, 5/4, 7/4, etc.) and feel (swing or straight) and for providing a grid or representation for beats should be created. The drum pattern may also relate to a pattern characterized by a feel other than straight and swing, such as triplet, 16th swing, etc. In this disclosure, feel is used to describe how a bar is split into a grid of expected note locations or grid points. Straight feel is used to indicate the case where quarter note times are split in half to get $8^{th}$ note times, and then $8^{th}$ note times are split in half to get 16th notes, etc. So if a 16th note resolution is used there will be 16 equally spaced grid points per bar for a 4/4 time signature. On the other hand, $8^{th}$ note swing (which we will refer to simply as swing) and "triplet feel" split quarter note times into three $8^{th}$ notes of equal interval. This gives 12 equally spaced grid points per bar for a 4/4 time signature. Although swing and triplet feel have the same grid point locations, music is generally referred to as swing when the predominant $8^{th}$ notes played are on the quarter notes (i.e., the on beats) and the $8^{th}$ note before the on beat. Triplet feel on the other hand uses the three 8th notes equally. For $16^{th}$ note swing or $16^{th}$ note triplet feel, quarter note times are split in half to get $8^{th}$ note times, but then $8^{th}$ note times are split into three $16^{th}$ notes of equal interval to give 24 equally spaced grid points per bar for a 4/4 time signature.

In one embodiment, when input is an audio signal, classifying the events may be based on the tone or pitch of the event, such that low tone elements may correspond to a kick drum component and higher tone elements may correspond to a snare drum component. In one embodiment, tone can be estimated by measuring the energy in multiple bands and computing the band centroid. The centroid may be characterized as:

$$C = \text{sum } Ei*i / \text{sum } Ei$$

where Ei is the energy in each band, and i is the band number. In this way, a signal with more energy in lower bands will have a lower centroid than a signal with more energy in higher bands. In one embodiment, six (6) frequency bands may be employed with frequency ranges of 20-100 Hz, 100-200 Hz, 200-600 Hz 600-2000 Hz, 2000-10000 Hz and 10000-20000 Hz. In this fashion, two muted strums of low guitar strings followed by a muted pluck of high guitar strings may correspond to two beats of a kick drum followed by a beat of a snare drum.

According to another embodiment, analyzing at block 115 includes analyzing the timing and number of input pad hits including recognizing order of input presses for kick and snare pads. In that fashion, two input pad hits of a kick drum pad followed by one input pad hit for a snare hit will result in a kick, kick snare pattern.

Analyzing at block 115 can include grouping events into different target drum patterns. For example, two classes are detected as implying either a kick drum hit or snare drum hit. In cases where the kick and snare are derived from audio input, pattern recognition techniques can be used to classify the input. In cases where the input is pad hits, the kick and snare can be determined by detecting which pad is hit.

Analyzing at block 115 can include reducing the number of events identified in the input. By way of example, some events may be pruned or removed during analysis at block 115, and thus, not included in rhythmic pattern determined for the input. Events may be pruned for being too low level, or too closely spaced together. In certain embodiments, events represented in the rhythmic pattern do not include pruned or removed events.

Analyzing at block 115 can also include determining a number of bars, time signature and feel for the rhythmic pattern. According to one embodiment, a spectral analysis is performed for input, such that analysis at block 115 reveals timing and classification of the input. The timing determined at block 115 can include determining event placement with respect to a beat characterization of the time interval and beat subdivisions. Spectral analysis may be performed to classify the inputs. At block 115, a rhythmic pattern for the events is determined that provides an arrangement of drum beats relative to a determined number of bars, determined time signature and determined feel for the plurality of events. The timing of the events may be correlated to drum hits, which is then analyzed to determine the number of beats, time signature and feel (e.g., straight or swing) of the drum pattern. The number of beats, time signature and feel can be used to create additional user selectable parts of the drum pattern, such as hi-hats, cymbals, shaker, tambourine, etc., as well as quantize the kick snare pattern to a musical grid. In one embodiment, analysis at block 115 includes performing a first classification of each event of the plurality of events within a first latency period to generate a sound response to detection of an event and performing a second classification of each event of the plurality of events within a second latency period for determination of the rhythmic pattern. The first latency period may be about 15 ms and the second latency period may be about 30 ms.

Analysis at block 115 may be based on calibration of the input discussed in more detail below with respect to FIG. 6.

At block 120, a drum pattern is generated. The drum pattern may be generated based on the rhythmic pattern determined at block 115. By way of example, the rhythmic pattern may be compared to one or more drum pattern templates or characteristics to identify one or more accompanying drum sounds and timing that may be applicable. For an input including a plurality of events played straight as a basic rock beat, the drum pattern generated at block 120 may include an application of hi-hat hits to the underlying groove, wherein the drum pattern is generated as a straight pattern. For an input including a plurality of events associated with a jazz beat or swing feel, the drum pattern generated at block 120 may include an application of hi-hat hits to the underlying groove, wherein the drum pattern is generated as a swing pattern. In this example, the hi-hat patterns selected for the rock and jazz patterns may be different in terms of number of drum beat elements, time signature employed, and location of the hi-hat hits within the drum patter (e.g., straight vs. swing).

In one embodiment, the drum pattern includes a drum element for each event of the rhythmic pattern. For example, classified input events may be assigned to beats of a determined grid to create a drum pattern. The grid may be a subdivision of the time interval based on the number of bars detected, a time signature and feel determined for the drum pattern, such that the grid includes subdivisions for each beat (typically 3 subdivisions for 8th note swing and 4 subdivisions for 16th note straight). The beat or sub-beat that each event lands on may be used to determine a level for each drum hit. Once the foundation groove is created, then additional drum elements such as high hats, tambourine etc. can be added based on selections from a list that matches the time signature and feel detected for the foundation groove. In addition, embellishment notes may be added to the drum pattern using one or more rules to make the resulting drum pattern sound like a professional drum beat. Generating a drum pattern at block 120 employs rules based on a list of pre-determined typical actions by a drummer. For example, it is very common for a drummer to play quiet snare on the 16th note before the start of a bar if the bar starts with a kick and if there is not a drum hit on the 8th note before the start of the bar. It is also common to play a snare between two kicks that land on a beat and the following 8th note. This same concept can be applied to the hi-hat, ride shaker patterns etc that are added to the kick snare pattern to create a full drum pattern. The resulting drum pattern can be stored in digital format and displayed to the user via a screen, pattern of LEDs. In addition the drum pattern can be played backed to the user using a sample player so the user can hear the resulting drum pattern for practice or performing.

According to one embodiment, generating a drum pattern at block 120 acknowledges that many drum patterns in modern music (e.g., Rock, Blues, Pop, Jazz, etc.) are primarily defined based on a combination of kick drum and snare drum. Other drum hits like hi-hats, cymbals, tambourine, etc. may be of secondary importance and may be represented by one or more pattern templates on top of the groove pattern. The drum pattern at block 120 may be generated the drum pattern based on a plurality of drum pattern styles and plurality of time signatures.

According to certain embodiments, process 100 may optionally include outputting the drum pattern at block 125. According to another embodiment, generating the drum pattern at block 120 includes at least one of outputting audio sounds for the drum pattern, storing the drum pattern, and outputting a display for the drum pattern.

According to one embodiment, process 100 may further include outputting a sound element in response to each input. Sound samples may be output based on, and in response to, the input to assist the user in generating a drum pattern. In order to provide an indication each event in the input, process 100 may also include outputting a sound element for each detected event. Sound output can include a drum sample or tone to indicate each event. According to another embodiment, the sound output may be correlated to a particular drum component, such that a sample is output for a kick drum based on classification of the event as a kick drum component and a sample is output for a snare based on classification of the event as a snare component. According to another embodiment, the sound output may be output with low latency, such as within about 15-30 milliseconds of detection of the event. In one embodiment, process 100 may be configured to output the sound element within about 15 milliseconds.

According to one embodiment, generating a drum pattern at block 120 and process 100 do not require output of sound to generate a drum pattern. In certain embodiments, process 100 may include providing one or more visual displays associated with drum pattern generation. In one exemplary embodiment, input representing a beat tapped out naturally may result in a visual representation of input, such as a display of the pattern displayed on display of a typical drum chart and/or activation of one or more LEDs.

FIG. 2 depicts a graphical representation of a device for generating a drum pattern according to one or more embodiments of the present disclosure. According to one embodiment, device configurations are provided to generate drum patterns based on input, such as strums or scratches from a musical instrument or one or using input pads. Device 200 may interpret the actions and output a drum pattern. By way of example, device 200 allows for simple actions, such as muted strums, plucks, taps slap, pops, and/or scratches (e.g., sliding pick edge on string) to convey a desired rhythmic element of a drum pattern. As will be discussed below, device 200 may be configured to receive non-audio input.

FIG. 2 depicts device 200 including processing unit 205. According to one or more embodiments, device 200 may be configured to receive a user generated input including a plurality of events for generating a drum pattern. According to another embodiment, device 200 may be configured to receive audio signals and non-audio signals as input. Processing unit 205 relates to a processer configured to perform one or more operations. Processing unit 205 is configured to perform one or more processes described herein, such as process 100 of FIG. 1.

Device 200 is depicted in FIG. 2 as optionally including input 210, input pads 215 and 220, output 230 and drum pattern output 235. In some embodiments, device 200 includes all optional elements shown in FIG. 2.

Input 210, may relate to one or more input signals received by a device 200. Device 200 may be configured to connect to a musical instrument by way of one or more ports or cables. In certain embodiments, input 210 is received by a ¼ inch jack of device 200 for receiving musical instrument or microphone output. Alternatively, input 210 may be coupled to a microphone or other instrument.

Device 200 may optionally include input pads 215 and 220. According to one embodiment, input pads 215 and 220 may be assigned to components of a drum kit, such as kick drum and snare drum, respectively. Processing unit 205 may be configured to detect activation of input pads 215 and 220. Switch 225 relates to a control switch, such as a push switch. Processing unit 205 may be configured to detect activation of switch 225 and holds (e.g., short hold, long hold, etc.) of switch 225. Device 200 may additional include external footswitch support to add functionality and change the setup depending on whether you are using the pedal on the floor or at hand level.

According to one embodiment, output 230 represents output of device 200 which may include at least one of audio samples and display of a drum pattern. In some embodiments, device 200 includes a separate output 235 for generated drum patterns as one or more of audio and non-audio output.

According to one embodiment, device 200 is a guitar effects pedal configured to allow for generation of an accompanying drum pattern on output 235 in addition to output of the guitar signal on output 230. Device 200 may relate to a component or portion of another device, such as an effects unit, computing device, recording device, rack system, amplifier, etc. In one embodiment, device 200 allows for audio signals to be output from a musical instrument on output 230 and for drum patterns to be output on output 235. In that fashion, an accompanying drum pattern may be output along with output signals from the musical instrument as separate output signals. In addition, the musical instrument output and drum pattern output may be provided to two different output devices or speakers. Alternatively, and in some embodiments, device 200 may be configured to output audio signals from a musical instrument and drum patterns on the same output.

Device 200 may be configured to provide multiple operational states including a learning mode for generating drum patterns. Activation of switch 225 may result in device 200 entering a learning mode during which time audio signals from a connected instrument will not be provided to output 230. Once device 200 transitions out of the learning mode due to expiration of a predetermined period of time and/or activation of switch 225, the output 2300 may output audio signals from the instrument. Output 235 may be employed by device 200 to output one or more drum patterns.

According to one embodiment, device 200 is an intelligent drum machine for musicians, such as guitarists and bassists. By way of example, in one exemplary embodiment, simply scratching across guitar strings during a learning state can be used to teach device 200 a kick/snare pattern that forms the foundation of a desired beat or groove. Based on this pattern, device 200 is configured to output a professional sounding drum beat with different embellishments and variations to perfectly compliment the detected input during a learning state. Device 200 allows for maintaining a creative flow without having to search through lists of desired beats. In certain embodiments, up to 4 bars may be employed for scratching kick snare patterns. As will be discussed below, scratches or other techniques (e.g., muted strum, plucks, taps, etc.) may be employed to enter desired patterns.

As will be discussed in more detail below, device 200 may include additional input buttons and/or selection switches to define one or more of tempo, level (e.g., volume), style, embellishments, etc.

According to another embodiment, processing unit 205 and device 200 may be configured to provide one or more control features for generating drum patterns. In one embodiment, processing unit 205 utilizes high quality drum samples including multiple velocity layers, multiple samples per layer, extended loops, etc. In one embodiment, processing unit 205 utilizes stereo reverb on the drum mixes. According to another embodiment, device 200 may be used with other devices such as a looper (e.g., loop pedal). Processing unit 205 may be configure to provide a plurality of drum kit choices, such as one or more of a clean, power, brush, e-pop, and percussion kit. Alternative voicings may be provided for Kick/Snare and Hat/Ride Parts to allow for modification of a beat sound with different kick/snare sounds for each kit. Alternatively or in addition, hi-hat patterns may be swapped out for one or more of toms, shakers, and other percussion elements in general.

Processing unit 205 may be configured to create at least three parts (e.g., Verse/Chorus/Bridge) for each song and switch between them with a simple tap of the footswitch while playing. In one embodiment, drum patterns for up to thirty-six songs may be stored. Each part can be set to low, medium, or high volume—for example to help ramp up the intensity between verse and chorus. Tempo can be adjusted with the tempo knob and/or by tapping the tempo button (or a corresponding footswitch).

Figure 3A:
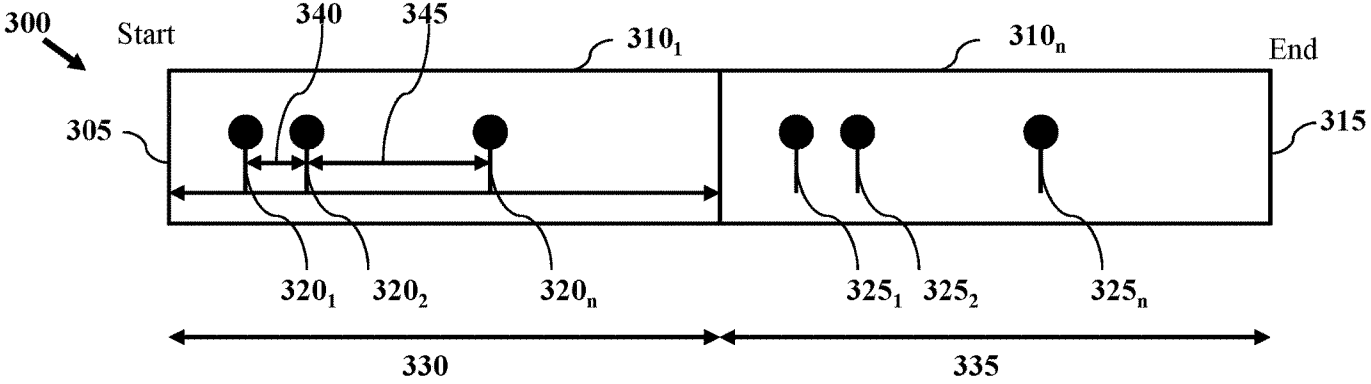
FIGS. 3A-3B depict graphical representations of input and events according to one or more embodiments.
Figure 3B:
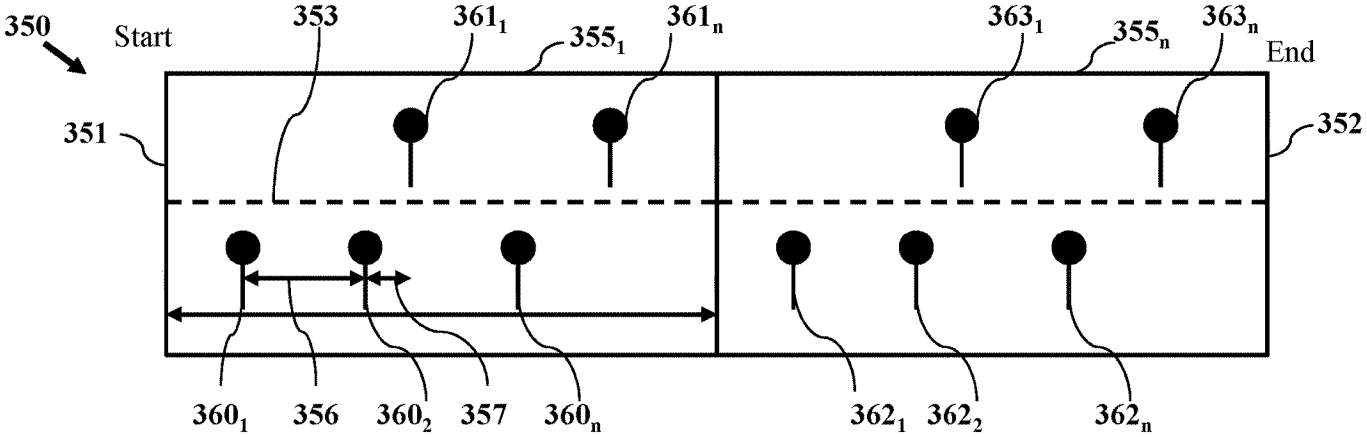

FIGS. 3A-3B depict graphical representations of input and events according to one or more embodiments. According to one embodiment, a drum pattern is generated and output based on input received over a period of time. According to one embodiment, the input is received during a learning mode. In addition, the learning mode may be set to one or more predefined bars, such as 1 bar, 2, bars, 3, bars, 4 bars, etc. Alternatively, the learning mode may determine the appropriate bar length based on events detected in an input signal.

FIG. 3A depicts an exemplary representation of input 300. Input 300 includes start point 305, bars $\mathbf{310}_{1\text{-}n}$ and end point 315. In certain embodiments, start point 305 and end point 315 relate to the beginning and end of a learning mode. According to another embodiment, start point 305 and end point 315 may relate to activation of a switch of a device (e.g., device 200) to signal the beginning and end of input. Bars $\mathbf{310}_{1\text{-}n}$ relate to a unit of time for the input signal. In one embodiment, a learning mode may be predefined to be two (2) bars. According to one embodiment, input 300 includes a plurality of events $\mathbf{320}_{1\text{-}n}$ and $\mathbf{325}_{1\text{-}n}$ which may be percussive events. Events $\mathbf{320}_{1\text{-}n}$ may correspond to first bar $\mathbf{320}_1$ and events $\mathbf{325}_{1\text{-}n}$ may correspond to a second bar $\mathbf{320}_n$. Identification of a rhythmic pattern may be based on the number of events, such events $\mathbf{320}_{1\text{-}n}$ and $\mathbf{325}_{1\text{-}n}$, the timing between events, and duration of time determined for ear bar, shown as 330 and 335, of the input signal and/or learning period. Timing between events $\mathbf{320}_1$ and $\mathbf{320}_2$ is identified as 340 and timing between events $\mathbf{320}_2$ and $\mathbf{320}_n$ is shown as 345.

According to one embodiment, events $\mathbf{320}_{1\text{-}n}$ correspond to a plurality of input events associated with output by a user, such as strums or scratches on a guitar. The user may similarly repeat the output resulting in identification of events $\mathbf{325}_{1\text{-}n}$. According to one embodiment, events $\mathbf{320}_{1\text{-}n}$ and $\mathbf{325}_{1\text{-}n}$ relate to a monotype input. By way of example, when a guitar is utilized to generate the input signal, events $\mathbf{320}_{1\text{-}n}$ and $\mathbf{325}_{1\text{-}n}$, may be associated with strums or scratches of the guitar strings. According to another embodiment, events $\mathbf{320}_{1\text{-}n}$ and $\mathbf{325}_{1\text{-}n}$ may be classified as elements of a drum pattern. By way of example, events $\mathbf{320}_{1\text{-}2}$ and $\mathbf{325}_{1\text{-}2}$ may be classified as low or kick drum elements, and events $\mathbf{320}_n$ and $\mathbf{325}_n$ may be classified as high or snare drum elements.

FIG. 3B depicts an exemplary representation of an input 350. Input 350 may include a plurality of events similar to input 300. According to another embodiment, input 350 depicts representation of input events having different tone or pitch qualities. According to one embodiment, input may be output by a user with multiple events, where some events may correspond to a lower pitch with other events include a higher pitch. By way of example, a guitar may output an input signal where the user strums low strings to indicate a low drum element (e.g., kick drum) and strums the high strings to generate a high drum element (e.g., snare drum).

Input 350 includes start point 351, bars $\mathbf{355}_{1\text{-}n}$ and end point 352. Similar to input pattern 300, input pattern 350 is depicted as two bars $\mathbf{355}_{1\text{-}n}$ in length. According to one embodiment, input pattern 350 includes a plurality of events $\mathbf{360}_{1\text{-}n}$, $\mathbf{361}_{1\text{-}n}$, $\mathbf{362}_{1\text{-}n}$, and $\mathbf{363}_{1\text{-}n}$ which may be percussive events. Events $\mathbf{360}_{1\text{-}n}$ may correspond to low elements of first bar $\mathbf{355}_1$ and events $\mathbf{361}_{1\text{-}n}$ may correspond to high elements of first bar $\mathbf{355}_1$. Similarly, events $\mathbf{362}_{1\text{-}n}$ may correspond to low elements of second bar $\mathbf{355}_n$ and events $\mathbf{363}_{1\text{-}n}$ may correspond to high elements of second bar $\mathbf{355}_n$. Identification of a rhythmic pattern may be based on the number of events, such events $\mathbf{360}_{1\text{-}n}$, $\mathbf{361}_{1\text{-}n}$, $\mathbf{362}_{1\text{-}n}$, and $\mathbf{363}_{1\text{-}n}$, the timing between events, and duration of time determined for each bar, shown as $\mathbf{355}_1$ and $\mathbf{355}_n$, of the input signal and/or learning period. Timing between events $\mathbf{360}_1$ and $\mathbf{360}_2$ is identified as 356 and timing between events $\mathbf{360}_2$ and $\mathbf{361}_1$ is shown as 357.

According to one embodiment, events $\mathbf{360}_{1\text{-}n}$ and $\mathbf{362}_{1\text{-}n}$ correspond to a plurality of input events associated with output by a user, such as strums or scratches on low strings (e.g., lower pitched strings) of a guitar. Events $\mathbf{361}_{1\text{-}n}$ and $\mathbf{363}_{1\text{-}n}$ correspond to a plurality of strums or scratches on high strings (e.g., higher pitched strings) of a guitar. Events of input 350 may be classified based on timing, number and bar length. According to another embodiment, events of input pattern may be classified based on tone or pitch relative to reference 353. By way of example, events $\mathbf{360}_{1\text{-}n}$ and $\mathbf{362}_{1\text{-}n}$ may be classified as low or kick drum elements, and events $\mathbf{361}_{1\text{-}n}$ and $\mathbf{363}_{1\text{-}n}$ may be classified as high or snare drum elements.

Figure 4B:
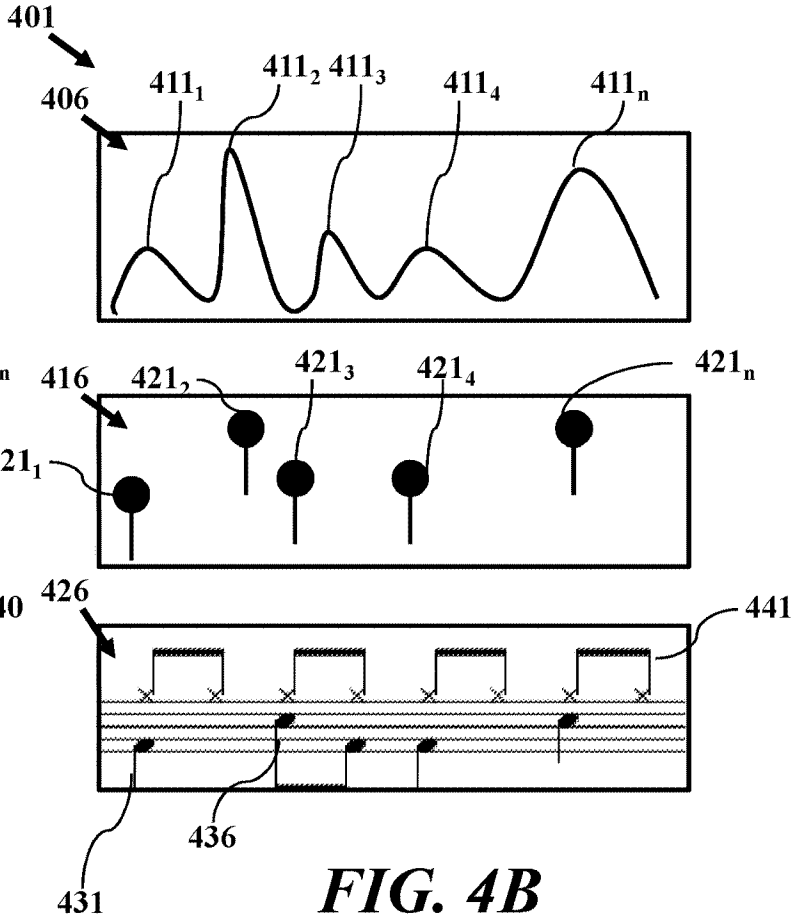
FIGS. 4A-4D depict graphical representations of generating drum patterns according to one or more embodiments.
Figure 4A:
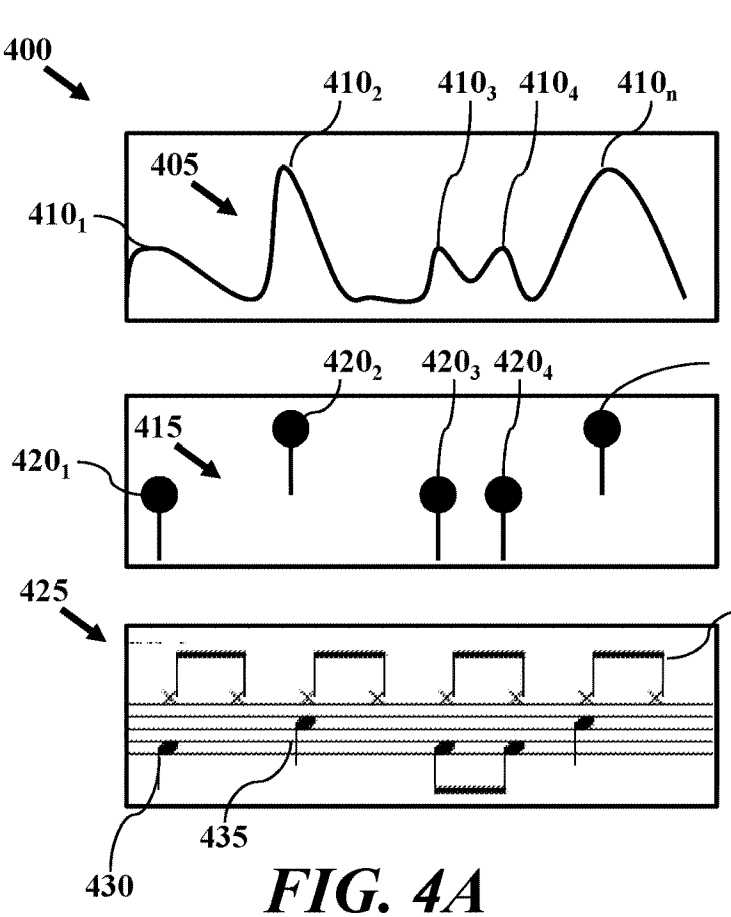

FIGS. 4A-4D depict graphical representations of generating drum patterns according to one or more embodiments. FIG. 4A depicts process 400 including receiving input signal 405, detection of events 415, and output of a drum beat pattern 425. According to one embodiment, input signal 405 is received and one or more events are determined based on elements of the input signal. According to one embodiment, events in FIGS. 4A-4D may be detected and analyzed with respect to a plurality of frequency bands such that at least one of the bands includes a response. Events may include multiple features, such as a response or value associated with a plurality of the frequency bands. Each feature of an event may be represented by a signal peak. Accordingly, for purposes of illustration, FIGS. 4A-4D depict signal peaks. However, event detection and classification may be based on multiple features or values associated with a plurality of frequency bands. Process 400 may include detecting at least one feature for each event in the audio input signal. In one embodiment, features $\mathbf{410}_{1\text{-}n}$ are detected. Features $\mathbf{410}_{1\text{-}n}$ may have one or more amplitude values. According to one embodiment, amplitude values of features $\mathbf{410}_{1\text{-}n}$ may be detected to classify each peak as an event type. Events 415 are depicted in FIG. 4A including a plurality of percussive events $\mathbf{420}_{1\text{-}n}$, wherein elements $\mathbf{420}_1$, $\mathbf{420}_3$ and $\mathbf{420}_4$ are classified as low or kick drum elements and events $\mathbf{420}_2$ and $\mathbf{420}_n$ are depicted as high or snare drum elements. According to one embodiment, events $\mathbf{420}_{1\text{-}n}$ match the number of detected peaks $\mathbf{410}_{1\text{-}n}$.

According to another embodiment, drum pattern 425 may be generated based on events $\mathbf{420}_{1\text{-}n}$. Drum pattern 425 is depicted as a single bar including low or kick drum beats, such as beat 430, high or snare drum beats, such as beat 435. According to one embodiment, drum pattern 425 includes additional rhythmic elements, such as hi-hat beats 440. According to one embodiment, the number of hi-hat beats, drum pattern tempo and style may be generated based on a rhythmic pattern identified for events $\mathbf{420}_{1\text{-}n}$ and one or more device settings.

FIG. 4B depicts process 401 including receiving input signal 406, detection of events 415, and output of a drum beat pattern 426. Similar to process 400, process 401 includes identification of a number of events (e.g., 5 events in FIG. 4B) with generation of a different rhythmic pattern and different drum pattern.

According to one embodiment, input signal 406 is received and one or more events are determined based on characteristics of the input. In one embodiment, features $\mathbf{411}_{1\text{-}n}$ are detected. Features $\mathbf{411}_{1\text{-}n}$ may have one or more amplitude values. According to one embodiment, amplitude values of features $\mathbf{411}_{1\text{-}n}$ may be detected to classify each peak as an event type. Events 416 are depicted in FIG. 4B including a plurality of percussive events $\mathbf{421}_{1\text{-}n}$, wherein events $\mathbf{421}_1$, $\mathbf{421}_3$ and $\mathbf{421}_4$ are classified as low or kick drum elements and events $\mathbf{421}_2$ and $\mathbf{421}_n$ are depicted as high or snare drum elements.

According to another embodiment, drum pattern 426 may be generated based on events $\mathbf{421}_{1-n}$ and a rhythmic pattern of the events. Drum pattern 426 is depicted as a single bar including low or kick drum beats, such as beat 431, high or snare drum beats, such as beat 436. According to one embodiment, drum pattern 426 includes additional rhythmic elements, such as hi-hat beats 441. According to one embodiment, the number of hi-hat beats, drum pattern tempo and style may be generated based on a rhythmic pattern identified for events $\mathbf{421}_{1-n}$ and one or more device settings.

FIG. 4B depicts that the timing of events $\mathbf{421}_{1-n}$ as determined by the device can control the resulting drum pattern. In this fashion, a user, even if not actually aware of the time signature, number of beats per minute, or even names of drum beats can scratch out input signal 406 to generate a desired groove pattern that can be used to generated drum pattern 426.

Figure 4D:
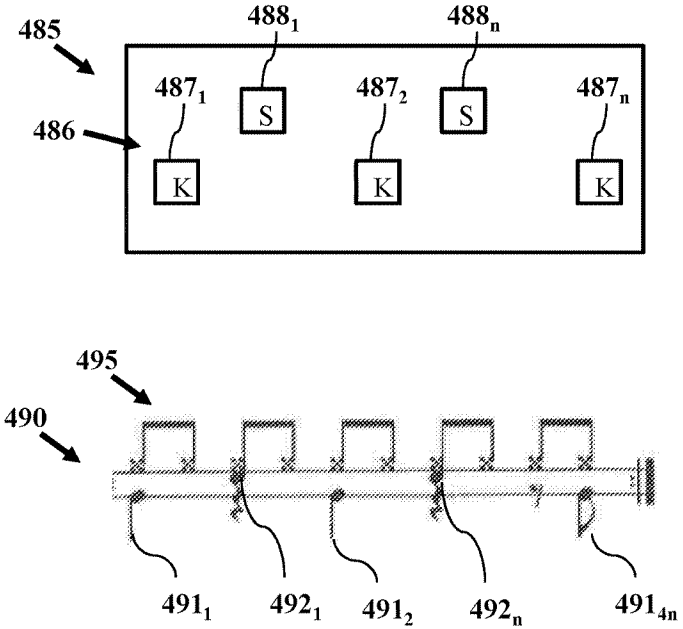
Figure 4C:
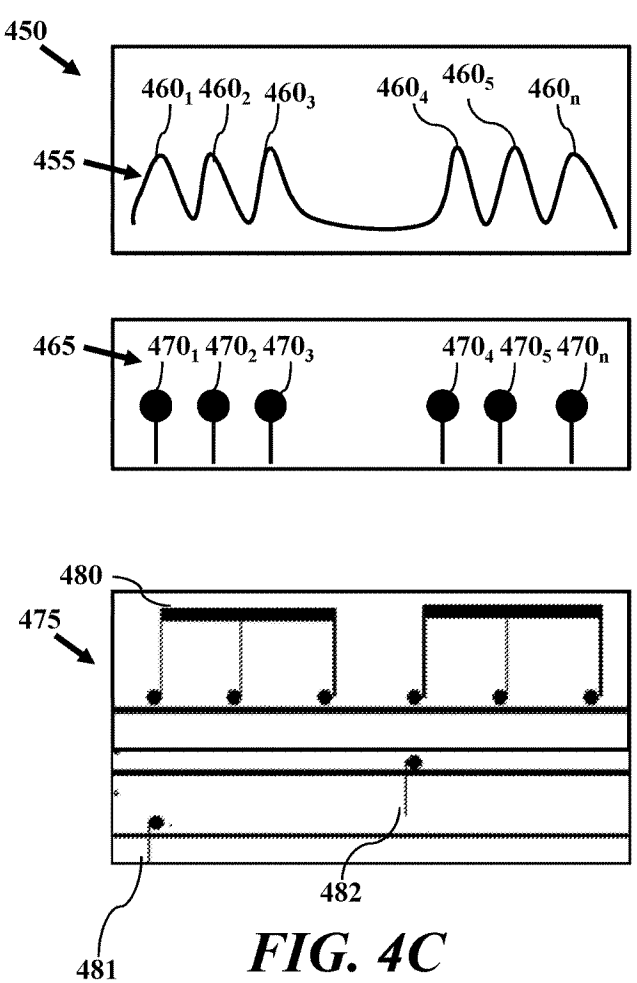

FIG. 4C depicts process 450 including receiving input 455, identification of events 465, and output of a drum beat pattern 475. Similar to process 400, process 450 includes identification of a number of events with generation of a rhythmic pattern and drum pattern.

According to one embodiment, input signal 455 is received and one or more events are determined based on elements of the input. In FIG. 4C, input 455 is depicted as a monotone input, wherein features $\mathbf{460}_{1-n}$ are detected with similar amplitudes relative to one or more frequency bands. According to another embodiment, input 455 is detected as including a triplet beat pattern based on the timing of features $\mathbf{460}_{1-n}$. According to one embodiment, based on the timing of peaks $\mathbf{460}_{1-n}$ and the peak amplitudes (e.g., features), peaks $\mathbf{460}_{1-n}$ may be classified as a single drum element type, such as a hi-hat drum component of a drum pattern. Accordingly, events 465 are depicted in FIG. 4C including a plurality of percussive events $\mathbf{470}_{1-n}$. According to one embodiment, events $\mathbf{470}_{1-n}$ match the number of detected peaks $\mathbf{460}_{1-n}$.

According to another embodiment, drum pattern 475 may be generated based on events $\mathbf{470}_{1-n}$. Drum pattern 475 is depicted as a single bar including low or kick drum beats, such as beat 481, high or snare drum beats, such as beat 482 and a plurality of hi-hat beats 480 which correspond to the detected percussive elements of input 455 and rhythmic pattern 465. According to one embodiment, the number of kick drum and snare drum elements in drum pattern 475 may be generated based on a rhythmic pattern identified for events $\mathbf{470}_{1-n}$ and one or more device settings.

FIG. 4C illustrates that the timing of events $\mathbf{460}_{1-n}$ as determined by the device can be matched to non-kick drum or non-snare drum patterns of drum beats. In this fashion, a user, even if unaware of the actual elements of a drum beat can identify a particular component of a drum pattern to generate input 455 and generate a desired drum pattern.

FIG. 4D depicts process 485 including receiving input 486, and generating drum pattern 490. Input 486 includes a plurality of pad hits $\mathbf{487}_{1-n}$ for kick drum components and $\mathbf{488}_{1-n}$ for snare drum pad hits. According to one embodiment, pad hits $\mathbf{487}_{1-n}$ and $\mathbf{488}_{1-n}$ are each associated as an event and analyzed. Process 485 includes identification of a number of events with generation of a rhythmic pattern and drum pattern for input 486.

According to one embodiment, based on the timing, bar length and feel determined for pad hits $\mathbf{487}_{1-n}$ and $\mathbf{488}_{1-n}$ drum pattern 490 is generated including drum components for such as kick drum beats $\mathbf{491}_{1-n}$ and snare drum beats $\mathbf{492}_{1-n}$ corresponding to pad hits $\mathbf{487}_{1-n}$ and $\mathbf{488}_{1-n}$. According to another embodiment, drum pattern includes hi-hat beats 495 represented as $8^{th}$ notes.

Figure 5:
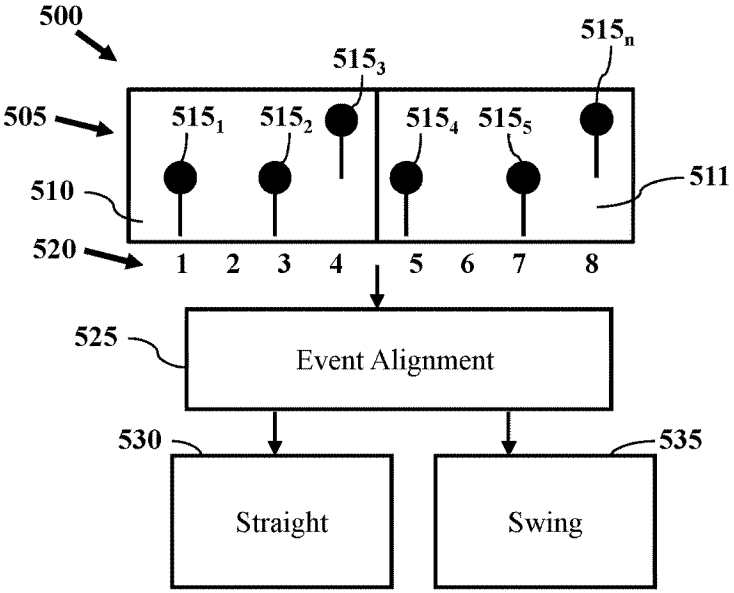
FIG. 5 depicts a process for analyzing input according to one or more embodiments.

FIG. 5 depicts a process for analyzing input according to one or more embodiments. As discussed herein, input may be analyzed to define a rhythmic pattern associated with events in the input. According to one embodiment, a rhythmic pattern may be determined based on the placement of elements within a time interval (e.g., learning period). Process 500 depicts an exemplary example of determining a number of bars, timing and feel. Process 500 includes input 505 include first bar 510 and second bar 511 for events $\mathbf{515}_{1-n}$. According to one embodiment, events $\mathbf{515}_{1-n}$ are detected in received input. According to one embodiment, events $\mathbf{515}_{1-n}$ are analyzed and two bars, bars 510 and 511 are determined to be the length of the user generated input pattern. According to one embodiment, two bars may be determined for events $\mathbf{515}_{1-n}$ based on the repeating nature of events, and the start and end times of the pattern. According to one embodiment, a time signature may be determined for events $\mathbf{515}_{1-n}$ and as such, each of bars 510 and 511 may be divided into subdivisions, such as beats. Determining the number of bars, timing and feel for input and events $\mathbf{515}_{1-n}$ may be based on predefined characterizations of drum patterns.

FIG. 5 also depicts an exemplary representation of bar beats 520, representing the subdivisions or counts. According to one embodiment, placement of events $\mathbf{515}_{1-n}$ associated with beats 520 can be used to distinguish between two similar inputs.

At block 525, process 500 includes determined event alignment within bars 510 and 511. Event alignment at block 525 may be based on the actual timing between input of events $\mathbf{515}_{1-n}$ relative to beats 520. Event alignment at block 525 can include classification of events to drum components. Based on alignment of events at block 525, process 500 may characterize the feel of the input. According to one embodiment process 500 may associate the input as having a straight feel at block 530 or as having a swing feel at block 535.

According to one embodiment process 500 performs event alignment at block 525 and determinations at blocks 530 and 535 to determine a timing style for the drum pattern. Two different drum patterns with similar drum beats can sound similar but have a different feel based on how the music is played. The feel may be due to timing associated with the drum pattern. Modern music styles of rock, blues and jazz are played with either straight timing or swing timing. In many cases, straight timing is where the beat is split into equal subdivisions (a ratio of 1:1) for playing notes. Swing timing is where the beat is split into two-third plus one-third subdivisions (a ratio of 2:1).

According to one exemplary embodiment, events $\mathbf{515}_{1-n}$ may be determined in process 500 based on knowledge of existing drum patterns to provide likely drum patterns. In an exemplary embodiment, process 500 may be employed to characterize input which may be associated with multiple drum patterns, such as 2 bars of a 3/4 straight pattern and 2 bars of 4/4 swing pattern. In these examples, each pattern may have a similar grid with event alignment to the grid at the same locations. According to one embodiment, based on musical knowledge, events $\mathbf{515}_{1-n}$ may be analyzed for event alignment with the on beats. A pattern having 6 on beats in 2 bars of 3/4, 8 on beats in the 2 bars of 4/4 in the pattern and the location of the snares can be used to choose the correct interpretation. Thus, in contrast to existing devices and configurations which require timing and feel to be specified before programming, here a user may simply input what they feel.

By way of another example, given a series of events that have been classified as kicks or snares and a time interval over which the events were detected, process and device configurations as described herein can generate estimations of a certain musical interpretation for the events. As one example, an estimate may be generated that the user intended to play 3 bars of 4/4 swing. This means that there should be 12 on beats (i.e., 4 beats per bar) in the estimation and 24 sub-beats, since each beat is divided into an on beat and 2 sub-beats for swing, which creates an equally spaced grid over the interval with 36 grid points. The likelihood that this estimation is correct can be determined by how well the events of the input line up with the grid points, as well as the pattern that is detected. A pattern that misses all the on beats is less likely to be correct than a pattern that hits the majority of the on beats. Similarly, a pattern that hits the sub-beat before the on beats is a very common swing pattern and thus, increases the probability that the interpretation is correct.

According to one embodiment, an overall likelihood score can be computed based on these individual likelihood scores, and the interpretation with the highest likelihood can be chosen as the correct interpretation. In one embodiment, likelihoods are computed for between 1-4 bars, timing signatures of 3/4 and 4/4, and a feel of straight and 8th note swing, resulting in a total of 16 interpretations.

Figure 6:
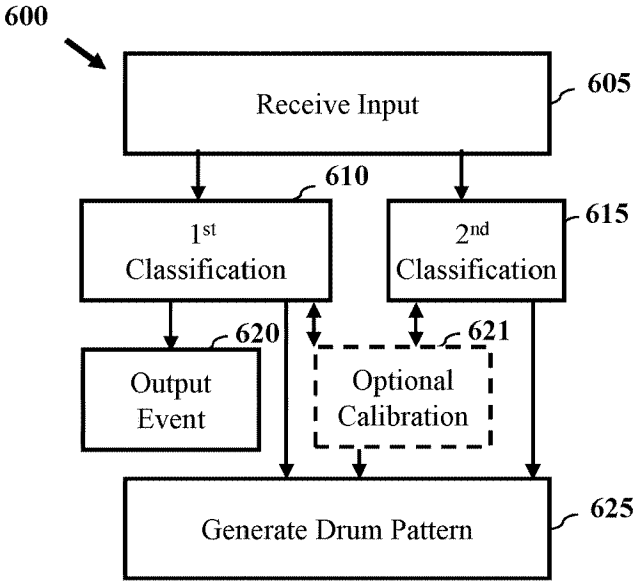
FIG. 6 depicts a process for classifying input according to one or more embodiments.

FIG. 6 depicts a process for classifying input according to one or more embodiments. Process 600 may be initiated by receiving input at block 605. According to one embodiment, two classification operations may be performed on received input from block 605. According to one embodiment a first classification is performed at block 610. A second classification is performed at block 615. A two stage classification may be useful to provide a user with a sense of the input elements generated and allow for accurate classification including correction if needed.

In order to feel the groove and prevent audio delay from confusing the user, drum samples may be output at block 620 with very low latency from the time of the input percussive event (typically <20 ms). Playback of drum samples (e.g., kick and snare sounds) in response to received input provides the user with feedback to assist entering a groove (e.g., submitting input). Playing drum samples out with very low latency may lead to errors when events are classified with low latency and due to a limited amount of information during the initial classification period. To improve the classification accuracy, but still keep low latency, two stage classification is performed at blocks 610 and 615. According to one embodiment, a first classification stage at block 620 operates at low latency (typically 15 ms) and is used for play back of drum samples for the user in real time at block 620. The second stage classification at block 625 operates at a larger latency (typically 30 ms) and can be used to over-ride the first stage classification. The second stage classification at block 625 may be used to create a drum sample if it is different from the first stage, and in addition it can be used in the timing analysis used to create the actual output drum pattern. In some cases it might be better to use a second stage classification at block 625 without actually playing back the corrected sample to the user immediately in which case the second stage classification latency could be even larger. Block 620 allows or outputting a sound element for each detected event, wherein the sound element is output within about 15 milliseconds of detection of the event. Similarly, block 625 allows for a second stage classification to be performed in about 30 milliseconds.

In one embodiment, analysis at block 610 includes performing a first classification of each event of the plurality of events within a first latency period to generate a sound response to detection of an event. At block 615, a second classification of each event of the plurality of events is performed within a second latency period for determination of the rhythmic pattern. In an exemplary embodiment, the first latency period at block 610 may be about 15 milliseconds and the second latency period at block 615 may be about 30 milliseconds. In one embodiment, the classification stage at block 620 classifies the input within a time period of about 10-30 milliseconds. Classification at block 625 may performed within the time period of about 30-60 milliseconds. It should be appreciated that these time periods are exemplary and other time periods may be employed.

According to one embodiment a two stage classification provides feedback for multiple types of input to a user to provide a level of feel/feedback and allows for correction of event classification. According to one embodiment, devices and processes described herein can allow for indications of kick and snare hits to be communicated. In addition, providing a real kick and snare sound in response to the audio input with as low latency of possible improves the ability of the device to interpret natural beat patterns provided by a user. If the latency is too large (>25 ms) then it becomes difficult for a user to play the groove they are feeling. If the latency is too low (<10 ms) then the classification rate becomes very poor as there is not enough audio to determine whether the person intended to signal a kick or a snare. In order to achieve very low latency (~15 ms), which makes the system feel very responsive, the system may be prone to making the occasional classification error for some audio inputs. A second classification stage operates at a larger latency (~30 ms) which is in general too slow for a user to feel the groove of output sound samples but results in very low classification errors. The second classification stage is used in the analysis to create a resulting drum pattern. In one embodiment, when playing the user only hears a single drum hit since the first stage and second stage mostly get the same result, but in some cases, the user will hear a double hit (e.g., kick followed by snare) so they will know the correct result in the end while still allowing to feel the groove due to the first hit coming in low latency.

At block 625, drum patterns may be generated. Drum patterns generated at block 625 may include one or more corrections to classification of input events based on the second classification at block 621. Generating the drum pattern at block 625, as described herein, can include enhancing a groove pattern of kick and snare components with one or more other drum sounds. In one embodiment, a resulting drum pattern may be enhanced to sound like it was played by a real drummer by adding embellishments such as extra drum hits or ghost notes. The amount of embellishments added to a drum pattern may be controlled, in one embodiments on a scale of 0-10. When the embellishment is level 0, the user will hear just the kick and snare pattern provided form input. However, when the embellishment control increases, ghost notes (i.e., non-accented hits played quieter than main drum hits) will be played by an algorithm that models what a real drummer would do. For example, it is very common for a drummer to play a quiet snare on the $16^{th}$ note before the start of the bar if the bar starts with a kick and if there is not a drum hit on the $8^{th}$ not before the start of the bar. It is also common to play a snare between two kicks that land on a beat following the $8^{th}$ note. The same concept can be applied to hi-hat, ride, shaker and drum instrument patterns in general that are added to the kick snare pattern to create a full drum pattern.

Process 600 may optionally perform a calibration at block 621. According to one embodiment, a calibration step at block 621 can calibrate input instrument (e.g., guitar, bass, vocals, ukulele, etc.) in order to maximize the success of event classification. Calibration at block 621 may be optional. The calibration at block 621 can include a receiving a number of events of the low hit (kick class) from the user and a number of events of the high hit (snare) class. These events are then analyzed using statistical methods to obtain an optimal classifier for that particular user and instrument. Further, a "blind classifier" may be employed that dynamically computes class statistics by analyzing the input events with no a priori information other than the fact that a combination of low hits and high hits are expected. The calibration approach can be generalized to handle more than two input classes. According to one embodiment, calibration at block 621 may provide one or more parameters to blocks 610 and block 615 for classification of input, such as one or more feature values in one or more frequency bands which can be employed as a reference for detection and analysis of events.

Figure 7:
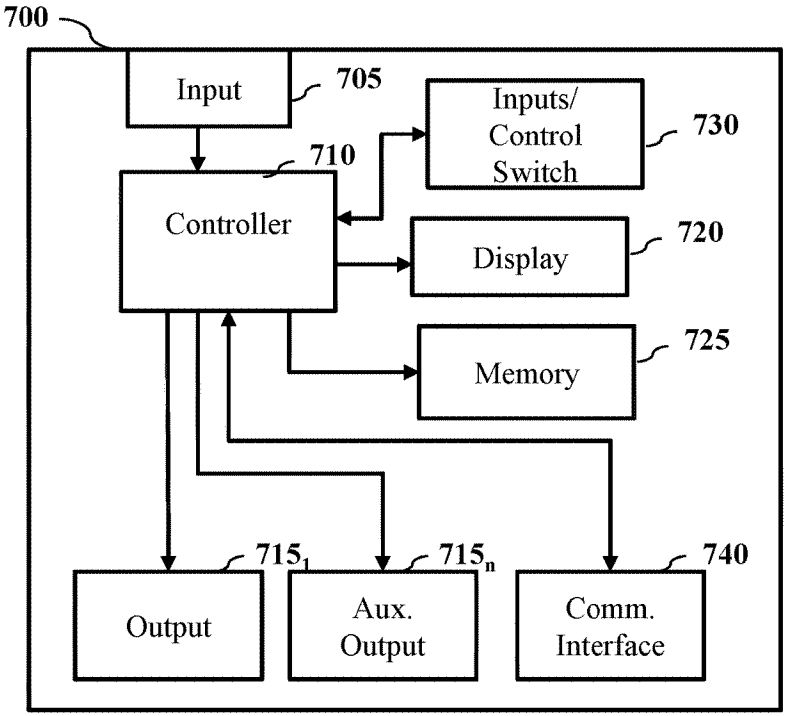
FIG. 7 depicts a device configuration according to one or more embodiments.

FIG. 7 depicts a device configuration according to one or more embodiments. Device 700 includes input 705, controller 710 and outputs $\mathbf{715}_{1\text{-}n}$.

Input 705 may be configured to receive one or more audio signals including percussive events to generate a drum pattern. Controller 710 may be configured to receive input signals and determine one or more drum patterns. Drum patterns determined by controller 710 may be output by outputs $\mathbf{715}_{1\text{-}n}$. Output $\mathbf{715}_1$ relates to an output for a musical instrument. In certain embodiments, a drum pattern may be provided via output $\mathbf{715}_1$. In other embodiments, auxiliary output $\mathbf{715}_n$ may be used for drum patterns. According to one embodiment, controller 710 is configured to identify one or more percussive events in the audio input signal, and determine a rhythmic pattern based on the one or more percussive events. Controller 710 may also be configured to generate a drum pattern based on the rhythmic pattern, and output the drum pattern to include one or more drum sound elements.

In certain embodiments, device 700 includes display 720. Display 720 may relate to one or more lighted elements of the device to signal a current operational state, setting of device 700 and information in general. In certain embodiment, display 720 may be configured to present a user interface for control of device 700.

Memory 725 is configured to store one or more executable instructions of controller 710. Memory 725 may include non-transitory storage of executable instructions. Inputs/control switches 730 may include one or more push buttons or control elements to allow for selection of control settings. Communication interface 740 may be configured to output one or more drum beat patterns, receive external controls (e.g., footswitch controls), and allow for communication of device 700 with one or more other devices.

According to one embodiment, device 700 is configured to output a professional sounding drum beat with different embellishments and variations to perfectly compliment the detected input during a learning state. Embellishments and variations may be based on one or more settings of inputs/control switches 730. In one embodiment, device 700 may be configured to store up to 36 different songs. Beats and sound elements of drum patterns may be played from a choice of multiple drum kits (e.g., 5 drum kits) different kits covering a wide range of genres. Device 700 is configured to support at least three different parts (e.g. verse/chorus/bridge) for each drum pattern that can be switched on the fly for enhancing live performances and exploring song ideas.

Figure 8:
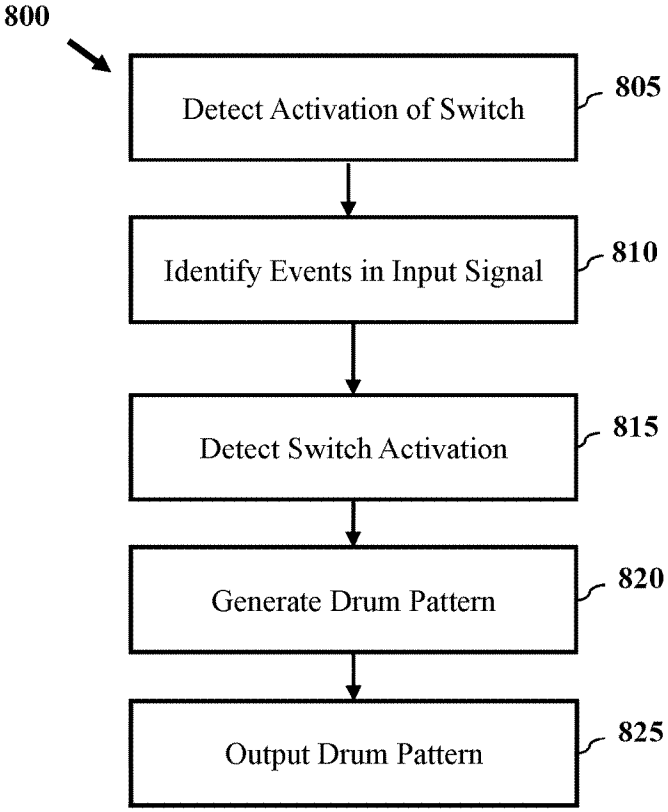
FIG. 8 depicts a process for device operation according to one or more embodiments.

FIG. 8 depicts a process for device operation according to one or more embodiments. Process 800 may be employed by a device for generating drum beat output from an audio signal. According to another embodiment, process 800 includes entering and exiting a learn mode for identify rhythmic patterns and teaching patterns. Based on a learn mode, one or more drum patterns may be generated and output. Process 800 may be employed by one or more devices described herein.

Process 800 may be initiated by detecting activation of an input for entering a learning state at block 805. The device receives an input signal identifies a plurality of input events at block 810. The input signal including a plurality of input events is received from one or more of a musical instrument and push-button inputs of the device. The input signal received at block 805 may relate to a users desired groove pattern. The input signal is received during a learning state of the device. The device may be configured to detect the input signal and correlate input to a predefined number of bars, such as two bars (e.g., measures).

According to one embodiment, process 800 allows a device described herein to learn drum patterns received from musical instruments, such as guitar players and bass players. By way of example, a strumming hand of the user may be used to "scratch" drum beats, wherein strings are muted with the fret hand. A kick drum pattern may be input by strumming the lowest one or two strings with the strings muted to create a percussive "low" sound, and a snare drum pattern may be input by strumming the highest one or two strings with the strings muted to create a percussive "high" sound. In certain embodiments, bass players may prefer to slap the low string for a kick, and pluck the muted high string for a snare. In alternative embodiments, kick and snare pads of the device may be employed instead of using a guitar to allow for drum beat creation to accompany acoustic guitars, fiddles, ukuleles, etc. that don't have a pickup or are not connected to the device by a microphone, pickup, etc. According to one embodiment, between one and four bars of a drum pattern may be detected at block 810. Input events may be detected at block 810 based on one or more pads hits.

At block 815, activation of the input is detected to complete the learning state. One or more percussive events are identified based on one or more of event features and push-button activation of the device. The one or more percussive events may be classified as drum pattern elements associated with kick drum and snare drum components of a drum pattern At block 820, a drum pattern is generated based on a plurality of input events detected in the input signal during the learning state. Process 800 also includes determining a rhythmic pattern based on the plurality of input events, wherein the rhythmic pattern is determined based on the classification, number and timing of the input events. The rhythmic pattern is determined by characterizing the one or more percussive events with components of predefined drum patterns. Percussive events may be each classified based on percussive element pitch as a drum pattern element associated with one of a kick drum component and snare drum component of a drum pattern.

A block 820 a drum pattern is generated based on the rhythmic pattern. Generating the rhythmic pattern can include defining a pattern length, defining a repeated pattern of drum strokes for the pattern length, and defining placement of each of the drum strokes during the pattern length. Generating the drum pattern includes matching the rhythmic pattern to characteristic elements of predefined drum patterns to select one or more drum patterns to add to the rhythmic pattern. A controller of a device compares classified percussive events to one or more stored rhythmic patterns. By way of example, the number of percussive events may be compared to existing patterns and matched to characteristics of drum patterns. The rhythmic pattern is generated based on the number and timing of the percussive events. The rhythmic pattern may also be generated by characterizing the one or more percussive events with components of predefined drum patterns. According to one embodiment, the rhythmic pattern may also be generated based on settings of the device. For example, a user may calibrate or define a desired tempo or time signature (e.g., 4/4, 6/8, etc.) such that the occurrence of percussive elements may be more easily identified. Once a rhythmic pattern is generated, the controller of the device can identify drum patterns associated with the rhythmic pattern.

In one embodiment, percussive events may be identified in input by identification of beats in the audio signal. Beats may relate to one or more accents or rhythmic units in the signal. According to one embodiment, a controller of a device may perform an analysis of the input signal to identify signal features (e.g., peak analysis, multiple band analysis), feature tone differentiation, etc. One or more percussive events in the input signal may each be classified as drum pattern elements associated with a kick drum component and snare drum component of a drum pattern. By way of example, for four beats detected in a first measure, beats one and three may be classified as kick drum components and beats two and four may be classified as snare drum elements in one embodiment. Percussive elements may each be classified based on percussive element pitch. The one or more percussive events may be identified based on a comparison of features of the audio input signal to a signal low. By using a two bar period, beats in the first bar may be compared to beats in the second bar and subtle differences between the percussive events may be reconciled.

According to one embodiment, the drum pattern may be generated with one or more attributes. According to one embodiment, a kick/snare pattern of the input signal must correlate with a generated drum pattern. A controller may apply one or more attributes to the kick/snare pattern to form the rest of the drum beat. The controller may set the feel of the drum pattern as one of a straight or swing. The controller may define the part of the drum pattern to be played, for example, individual drum parts for each of a verse, chorus, and user interface settings. The controller may also determine an embellishment level providing a number of enhancements (such as ghost notes) that are added to the basic beat to create a more complex sound. The embellishment level may be set based on one or more user selections of the device between simple (no added notes) to busy (many added notes) using selection of the device (e.g., groove, kit, etc.). In addition, the controller may determine the variations applied to the drum pattern. The variation provides the type of repeating pattern that is applied to the foundation kick/snare pattern—it is controlled using a HATS/RIDES encoder of the device. Cymbal variation may be simple closed high hats on quarter notes, or complex open/closed patterns with added cymbals and ghosting. Variation settings may generally control the elements of a kit such as hi-hat and cymbals, and sometimes toms that are played in a steady rhythm, usually with the right hand. Some variations are kit dependent and choices will include useful percussion figures such as the clave in the percussion kit.

At block 825 the drum pattern is output to include one or more drum sound elements. In one embodiment, the outputting the drum pattern includes outputting a generated pattern based on a plurality of drum sounds based on a combination of drum sounds associated with a drum kit configuration. Outputting the drum pattern can include outputting a plurality of drum sounds for the drum pattern in a repeated loop.

Figure 9B:
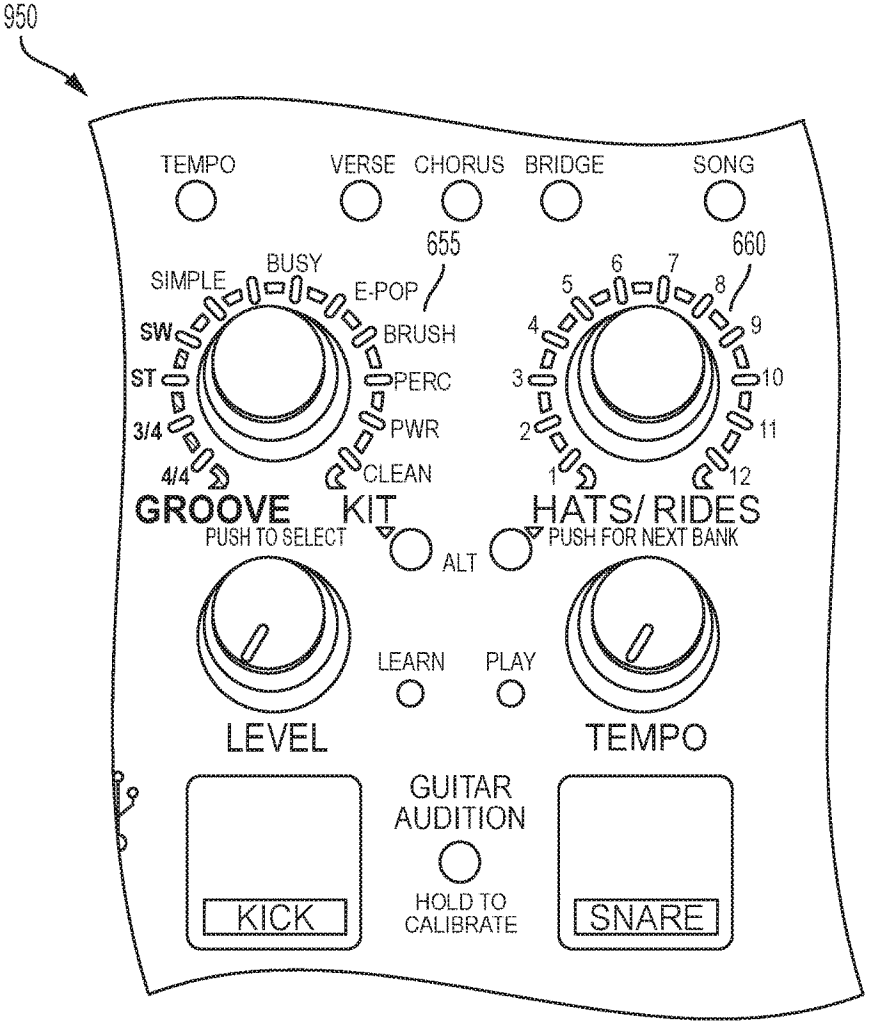
FIG. 9B depicts a graphical representations of control features according to one or more embodiments.
Figure 9A:
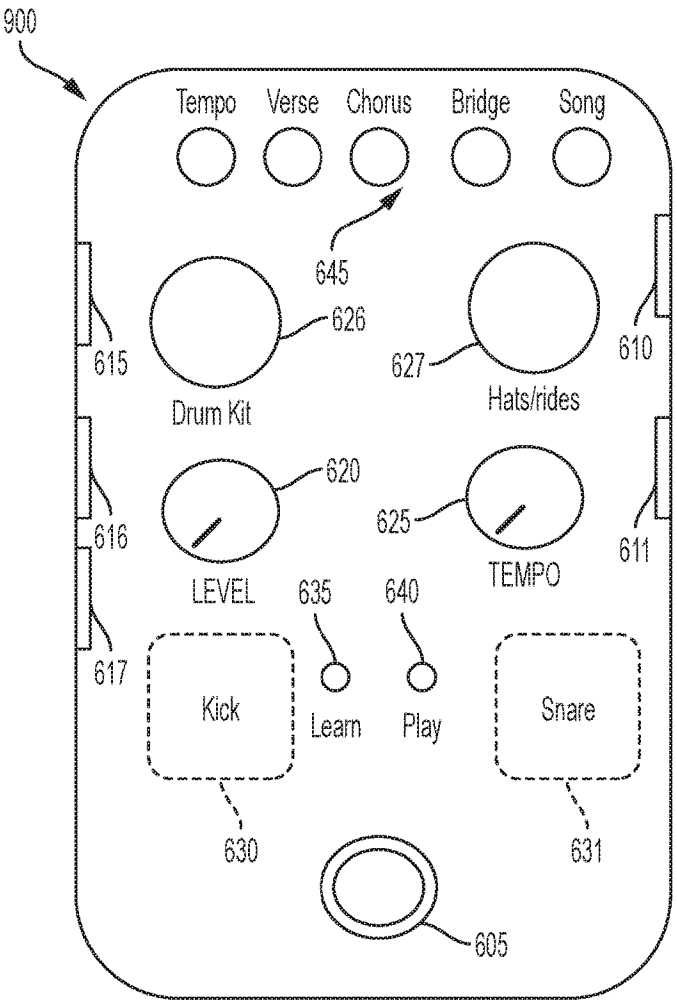
FIG. 9A depicts a graphical representations of a device according to one or more embodiments.

FIG. 9A depicts a graphical representation of a device according to one or more embodiments. According to one embodiment, device 900 relates to an effects pedal (e.g., guitar effects pedal, stomp box, effect unit, etc.) which may be configured to receive an audio input signal from the guitar. Device 900 may be employed to detect one or more input signals during a learn mode to generate a drum pattern. Device 900 may similarly allow for control of the drum pattern and one or more settings to allow for modifications to and embellishments to a drum pattern.

According to one embodiment, device 900 includes a housing having input and output connections on side faces and cone or more control elements on a top face of the housing. FIG. 9A depicts a top face of the housing of device 900. According to one embodiment, device 900 includes input 910 for receiving audio input signals from a musical instrument by way of a ¼ inch (0.635 cm) input jack. Input output terminals may relate to 1.4 inch jacks associated with guitar cables. Input 911 relates to a footswitch input which may allow for external control from a foot switch (e.g., three-way footswitch). Output 915 is configured to output one or more drum patterns and allow for musical instrument signals received via input 910. According to one embodiment, device 900 does not output instrument signals received via input 910 during a learning mode. Outputs 916 and 917 are stereo outputs.

Device 900 includes one or more controls to control output characteristics. Level knob 920 may be rotated to control the output level of device 900 and set the output drum level to match a guitar/instrument level. Tempo knob 925 may be rotated to control the output tempo of a drum pattern. The temp may be changes from a stored center position to a new tempo. In certain embodiments, the default temp may be stored by pressing and holding tempo knob 925. Selection knob 926 allows for selection of one or more of a time signature, style (e.g., straight, swing, etc.) and drum kit type. Selection knob 926 allows for selecting the amount of extra embellishments to enhance a basic pattern and overriding timing a feel. Selection knob 927 allows for selection of hi-hat and ride cymbal types. Selection knob 927 also allows to select the timing, 1/4 note (green LED), 1/8 note (amber LED), 1/16 note (red LED).

Device 900 may optionally include one or more pads, such as input pad 930 and 931 to allow for percussive events to be tapped. According to another embodiment, device 900 includes one or more lighted display elements to signal operation of the device. Lighted indicator 935 can indicate when device 900 is in a learn state. Similarly, lighted indicator 940 can indicate when device 900 is in playing a recorded song. Lighted indicators/buttons 945 may be employed to indicate settings or control of one or more of tempo, verse, chorus, bridge and song. Lighted indicators/buttons 945 may include tempo button which may be tapped to change tempo. When light, a red light may light for a first beat and green flash for remaining bead. If the tempo has been adjusted remaining beats may flash amber. This tempo button may be pressed and held to lock in an altered temp as a default. Lighted indicators/buttons 945 may include elements to indicate the current part of a song, wherein a button may be pressed for the song to change a selected part. Pressing lighted indicators/buttons 945 for song allows for a song mode to be entered.

FIG. 9B depicts a graphical representations of control features according to one or more embodiments. Control interface 950 relates to one or more controls that may be included in a device, such as device 900, or as part of another device such as effects pedals, control boards, multi-track recorders, digital audio workstations, etc. Control interface 950 includes elements similar to device 900. According to one embodiment, control interface 950 includes a plurality of lighted elements and a knob, shown generally as 955, associated with a selection knob to allow for selection of time signature, style (e.g., swing vs. Straight, and drum kit type, wherein rotation of the selector know may result in a device lighting a corresponding element. Selection of the control knob, by pressing on the knob, may set the device based on the lighted selection. Similarly, control interface 950 includes a plurality of lighted elements and a control knob, shown generally as 960, associated with a selection knob to allow for selection of hi-hats, cymbals, percussive elements, etc. Selection of the control knob by pressing may set the device based on the lighted selection.

Element 955 supports selection of five or more different drum kits. All kits except E-Pop will feature multiple velocity layers for all main drums (kick, snare, hats, toms, cymbals), with multiple samples at each velocity layer. E-Pop is an exception because synthesized drum machines do not typically alter the tone of a drum based on velocity. CLEAN provides a clean trap kit, suitable for rock, pop, and country styles. POWER provides a trap kit designed for hard rock, metal, and punk styles, with a more aggressive sound than the clean kit. BRUSH provides a vintage-sounding kit played with brushes, for jazz and folk styles. Also includes shaker and tambourine samples for folk. E-POP provides a kit made from synthesized drum sounds that emulate analogue drum machines. PERCUSSION provides a kit designed for Latin fusion styles, augmenting a clean trap kit with cowbell, clave, timbales, and congas.

During operation, a kit may always be selected as indicated by a corresponding LED lit green. By rotating element 955 a Kit/Groove encoder moves between different drum kits. Each drum kit will light dim green as the encoder is turned. Clicking the encoder will select the current kit and it will now be lit solid green. If the device is outputting a drum pattern, the kit change will be heard as soon as the encoder is pressed. Whenever a drum kit is selected on the Kit/Groove encoder, that kit becomes the default kit. It will be used when a new empty song is loaded or a song is cleared. The default kit is remembered between power cycles. When changing kits, it is possible to apply that change to all by parts automatically without having to select each part individually. Turn the encoder to select the new kit, then press and hold the encoder until the kit LED flashes three times. The change has now been made to all parts.

Embellishment selection 960 supports multiple embellishment levels. Low (Simple LED) embellishment level provides only Kick/Snare (or equivalent) for the non-metallic elements. No added ghost notes or extra drums (e.g. Toms). Medium embellishment level will add ghost notes and occasional extra drum hits. High (Busy LED) embellishment level will provide complex patterns ghost-note patterns and added drum hits on the toms and cymbals. When rotating the Kit/Groove encoder to move between different levels (3 LEDs), each level will light dim green as the encoder is turned. Clicking the encoder will select the current kit and it will now be lit solid green. If the device is playing, the embellishment change will be heard as soon as the encoder is pressed. When changing embellishment levels, it is possible to apply that change to all by parts automatically without having to select each part individually. Turning the encoder to select the new level, then press and hold the encoder until the level LED flashes three times. The change has now been made to all parts.

Control interface 950 can include Automatic Time Signature/Feel Selection in which the time signature and feel (straight or swing) of the user's input kick/snare pattern will be automatically determined. When the device goes from the Learning State to the Playing State, the automatically detected values will be reflected on the Kit/Groove display. The KIT/GROOVE encoder can be used to manually select the key signature and the feel.

Control interface 950 can include Time Signature Selection in which the device supports two main time signatures: 3/4 and 4/4. When the pedal is in the Cleared, Audition, Ready to Learn, or Learning states, no key signature LEDs will typically be lit. When the pedal has learned a kick/snare pattern (Playing, Outro, or Stopped states), the current key signature LED will be lit green. To override the automatic settings in a learned part, rotate the Kit/Groove encoder to move between different time signatures (2 LEDs). Each level will light dim green as the encoder is turned. Clicking the encoder will select the current time signature and it will now be lit solid green. If the device is playing, the time signature change will be heard as soon as the encoder is pressed. When changing time signature, it is possible to apply that change to all by parts automatically without having to select each part individually. Turn the encoder to select the new time signature, then press and hold the encoder until the time signature LED flashes three times. The change has now been made to all parts.

When in a cleared state, time signature may be pre-selected for cleared parts. In this case, the pre-selected LEDs will flash to remind the user that no automatic interpretation will take place. Note that when those parts are taught, the pre-selected timing and feel settings of the selected part are applied to all parts (e.g., Assume the verse is set to 3/4 swing and the chorus is set to 4/4 straight. If the verse is selected (bright) when teaching starts, both parts will interpret the input as 3/4 swing. If chorus is selected, both parts will be interpreted as 4/4 straight).

Control interface 950 can include Feel Selection in which the device supports both straight and swing feel. When the pedal is in the Cleared, Audition, Ready to Learn, or Learning states, no feel LEDs will typically be lit. When the pedal has learned a kick/snare pattern (Playing, Outro, or Stopped states), the current feel LED will be lit red. To override the automatic settings in a learned part, rotate the Kit/Groove encoder to move between different feels (2 LEDs). Each level will light dim red as the encoder is turned. Clicking the encoder will select the current feel and it will now be lit solid red. If the device is playing, the feel change will be heard as soon as the encoder is pressed. When changing feel, it is possible to apply that change to all by parts automatically without having to select each part individually. Turn the encoder to select the new feel, then press and hold the encoder until the feel LED flashes three times. The change has now been made to all parts. When in a cleared state, feel may be pre-selected for cleared parts. In this case, the pre-selected LEDs will flash to remind the user that no automatic interpretation will take place. Note that when those parts are taught, the pre-selected timing and feel settings of the selected part are applied to all parts (e.g., Assume the verse is set to 3/4 swing and the chorus is set to 4/4 straight. If the verse is selected (bright) when teaching starts, both parts will interpret the input as 3/4 swing. If chorus is selected, both parts will be interpreted as 4/4 straight).

Control interface 950 can include a Hats/Rides Encoder in which the user is allowed to select from 36 different variations (12 basic variations at 3 different sub-beat rates). Each variation has a different sound for the high-hat or equivalent "right-hand" drumming sound. Variations depend on the kit to some extent and include kit-specific options.

Control interface 950 can include Setting Default Behavior in a Cleared State in which for a freshly loaded song in a cleared state the device will be set to the most recently selected kit, medium embellishments, no time sig/feel preselected, variable ⅛th (yellow) selected, both alt buttons off. The verse will be selected at medium level (amber), and the chorus will be dim, high level (red), indicating that when the pedal is taught, the chorus will learn the same K/S pattern. If the user chooses to set up the bridge as well, it will default to low intensity (green). The user can also decide to change whatever parameters they want before teaching a KS pattern. This includes clicking the chorus so that it starts on the chorus, or clicking the bridge to change parameters in the bridge and make it be taught as well. While on any of these parts, the person can change the embellishment levels, hats/rides pattern, intensities, alts, etc. to set what they want to get after they teach the KS pattern. Note when a song is empty and ready to be taught, changes to the kit, timing, and/or feel will affect all parts.

If a person clears a song with a long hold of the FS, then we will clear the KS pattern in all parts (equivalent to clearing each part individually with a FS hold), and the settings will return to the default settings. Note that a user can clear a single part by pressing and holding the footswitch until the part button starts flashing.

Control interface 950 can include Tempo adjustment in which a Center-indent, turning to the left decreases the tempo, turning the right increases the tempo. The indented center position is the tempo that was detected during learning. As soon as the tempo is changed from the stored tempo, the TEMPO LED will flash amber instead of green. Pressing and holding the TEMPO button will save the current tempo as the new center detent (default) tempo and cause the TEMPO LED to flash green. Note that regardless of the tempo state, the first beat of each bar will be indicated with a red flash. The tempo range will be half-speed to double speed, however clamping may occur if these changes cause the tempo to exceed a maximum or minimum supported tempo. Whenever the tempo is changed without directly using the tempo knob, for example when teaching or loading a new song, or using tap tempo, the tempo knob will need to be moved back to the center detent position before it becomes active again. This prevents sudden tempo changes if the knob is nudged when the current position does not match the current tempo.

Control interface 950 can include Alt Buttons to toggle between off and green (for kick/snare) and off, green, and red (hats/rides). The two buttons are independent and can be on/off in any combination. Pressing them will immediately change the sound of the kick/snare (hat variation) to the Alt voicing, which is different for each kit.

Control interface 950 can include Tempo Button that flashes at the current part's tempo. The first beat of each bar flashes red, and subsequent beats flash green if the device is playing the nominal (center detent) tempo. Simply tapping the tempo button will change the tempo to the tapped tempo, and the tempo LED will flash amber instead of green for the subsequent beats to indicate the tempo has been changed from nominal. Pressing and holding the TEMPO button will save the current tempo as the new center detent (default) tempo and cause the TEMPO LED to flash green for the subsequent beats of the bar. When a part is empty and the metronome is on, the tempo LED will flash green at the current song tempo. For an empty song, this defaults to 120 BPM but can be adjusted by tapping the tempo button or turning the tempo knob. Metronome mode goes on automatically when a song has been taught and an empty part is selected or a part has been cleared. It can be turned on or off by pressing and holding the tempo button or the current part button when the current part is empty. The device may always play back at an integer BPM making it easier to match the BPM using an external device or DAW.

Control interface 950 can include Verse/Chorus/Bridge Part Buttons to select between three different drum parts. By default, when you teach the device a new song, the verse is selected as the active part, and the chorus is automatically populated with the same settings as the verse, but with a higher intensity and possibly faster hats/rides variation. The bridge is not automatically populated by default, and must either be taught separately, once the Verse/Chorus has been taught, or selected to be taught at the same time as the Verse/Chorus. When the device is in the Cleared State (e.g. the current song has been cleared, or is empty), the currently selected part is bright, and any other parts (default=just Chorus) that will learn the same KS pattern when teaching begins are dim. When the device is in the Stopped State, buttons for parts that have been taught will be lit, with the currently selected part lit brightly and the other parts lit dimly. Pressing the dim part button will cause that part to light brightly and the other parts to go dim. Pressing the currently selected (brightly lit part) will cause the part level to cycle between green (low), amber (mid), and red (high) level. Pressing and holding the currently selected part in the STOPPED state will turn on count-in mode—this is indicated by the current part button flashing at the current tempo. When a song is started via a footswitch press with count-in mode on, a stick click will play at the current tempo for the current number of beats per bar before the song starts. Note that when count-in is on, clearing a part or a song will be done silently. This is not possible when count-in is off as we start playback immediately on pressing the footswitch. Pressing and holding the current part button will toggle count-in mode. The count-in mode is remembered between song changes and power cycles. When a part has been cleared (by pressing and holding the FS until the part button flashes red), a metronome will sound. To turn off the metronome, press and hold the part button. Metronome mode goes on automatically when a song has been taught and an empty part is selected or a part has been cleared. It can be turned on or off by pressing on the current part button when the current part is empty.

When the device is in the Playing State, buttons for parts that have been taught will be lit will be lit, with the currently selected part lit brightly and the other part lit dimly. Pressing the dim part button will cause that part flash at the current tempo, and the device will change to the new part at the start of the next bar. The new part button will be brightly lit and the previous part button will be dim. Pressing the currently selected (brightly lit part) will cause the part level to cycle between green (low), amber (mid), and red (high) level.

Control interface 950 can include Song Button to change the Hats/Rides selector into a song selector. Pressing the song button turns off the current Hats/Rides LED in the array so it can be used to display song information instead. If the band was playing when the song button is pressed, then it will stop when a new song memory is selected. The song button will flash GREEN, and the current song will be brightly lit in the array. If any other songs have been stored, they are shown as dimly lit LEDs in the style array. The color of the LED in the array indicates the song bank (green/amber/red). Turning the Hats/Rides encoder selects a new song, and advances through the banks. For example, on the first cycle the LEDs will be green, and then when the encoder is turned from 12 to 1 they will turn amber, and finally red. This allows storage of up to 36 songs. The non-Hats/Rides LEDs will be lit to reflect what is stored in that song (e.g. Kit/Groove LED array will reflect what was stored for that song. If the selected song is empty, then the Learn and Play LEDs will be off indicating this. If there is a song stored in the slot, then play LED will be dim green indicating we are in a stopped state.

Control interface 950 can include Kick/Snare Pads as an alternate way to teach the device. Tapping the pads will produce the corresponding kick or snare sound. When in the Ready to Learn state, the pads will work exactly like the guitar—so the pads can be used to train the pedal. To keep costs down, the pads are not velocity sensitive. The pads will be off when there is no kick/snare pattern taught for the currently active part—otherwise they will be dim, and will light brightly when tapped.

Control interface 950 can include Guitar Audition Button to turn on audition mode in which scratching the guitar creates kick or snare sounds depending on whether they are detected as low or high scratches. This provides a way of testing the current calibration as well as allowing someone to scratch out drum patterns to play the kick and snare live. The Audition mode is automatically turned on after calibration, and automatically turned off (LED goes dim) after teaching.

Figure 10:
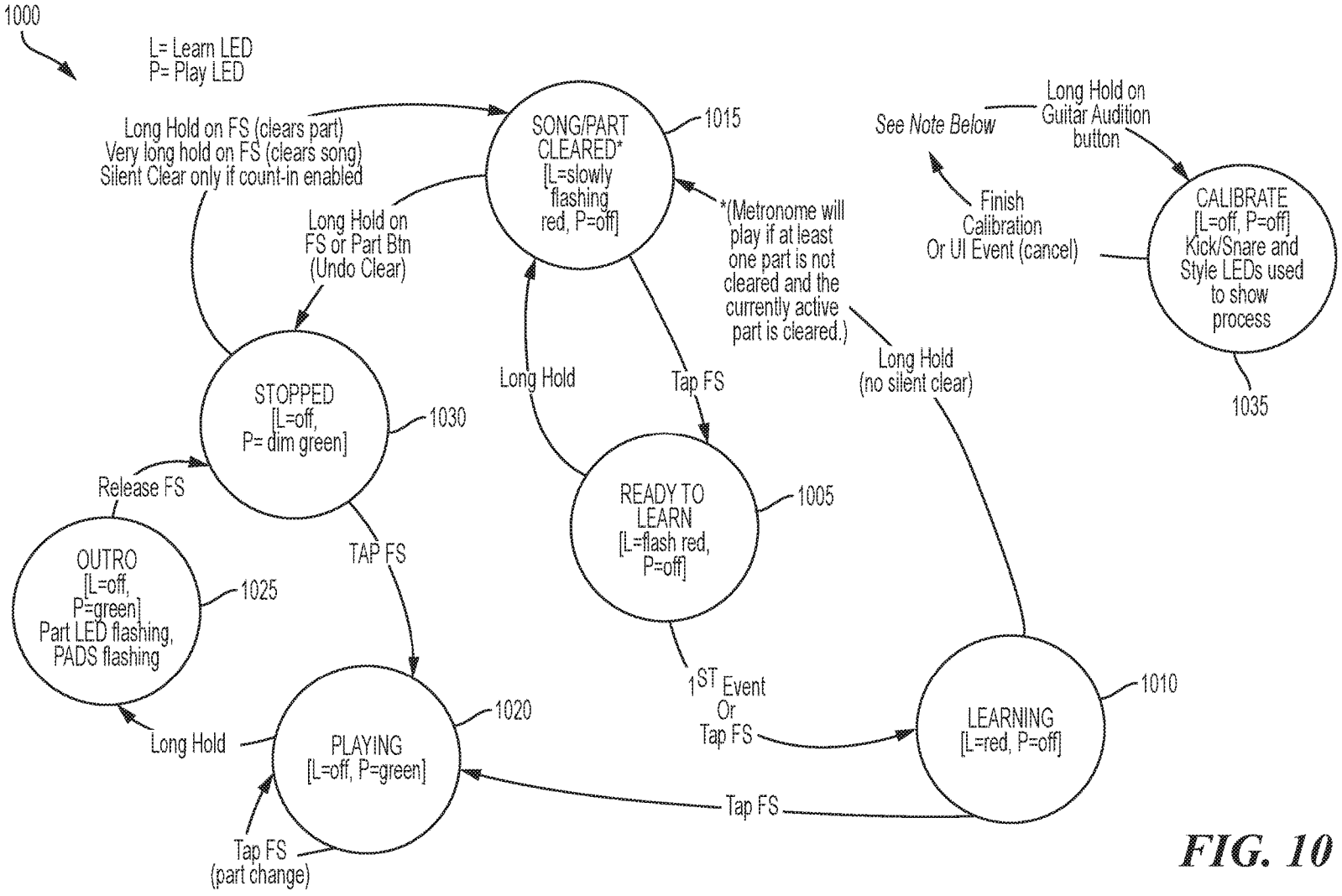
FIG. 10 depicts a graphical representation of device operation according to one or more embodiments.

FIG. 10 depicts a graphical representation of device operation according to one or more embodiments of the present disclosure. According to one embodiment, a device may have one or more operational states, shown generally as 1000, allowing for a learning mode, playback and calibration. According to another embodiment, one or more lighting elements of a device (e.g., LEDs, etc.) may signal one or more operational states. In addition, the device may be configured for control based on operation of a switch (e.g., push switch, foot switch, etc.) denoted as "FS" in FIG. 10.

According to one embodiment, operational states 1000 are described in FIG. 10 with respect to a learn LED ("L") and a Play LED ("P") which may relate to lighted indicators 935 and 940 of FIG. 6. READY TO LEARN state 1005 may be initiated by a user tapping a footswitch from a cleared state 1015. In READY TO LEARN state 1005, learn LED flashes red and Play LED is off. In READY TO LEARN state 1005, the guitar signal will be MUTED. If Guitar Audition is on, scratching low strings will produce a drum kick sound, and scratching the high strings will produce a drum snare sound (assuming the guitar has been calibrated correctly). In this state, the device is waiting for either an onset (to start the pattern) or a footswitch tap (to start the pattern without having a kick or snare on the first beat—e.g. for Reggae).

In response to a user input signal including one or more events, or an additional tap of the footswitch, the device switches to LEARNING state 1010 (learn LED is lit red and Play LED is off). During LEARNING state 1010, the user outputs a rhythmic pattern. By tapping the footswitch in LEARNING state 1010, PLAYING state 1020 (learn LED is off and Play LED is lit green) is entered and a drum pattern is output. In LEARNING state 1010, a long hold of the control switch will end the learning operation and trigger SONG/PART CLEARED state 1015. In LEARNING state 1010, the guitar signal will be MUTED. If Guitar Audition is on, scratching low strings will produce a drum kick sound, and scratching the high strings will produce a drum snare sound (assuming the guitar has been calibrated correctly). In this state, the device is recording the drum hits and timing until the footswitch is tapped to end the recording. We may light the kick and snare LEDs as well.

In SONG/PART CLEARED state 1015, the pedal is off, guitar input is passed through unprocessed to AMP OUT (if connected), or Left/Right Mixer output jacks otherwise. If Guitar Audition is on, scratching low strings will produce a drum kick sound, and scratching the high strings will produce a drum snare sound (assuming the guitar has been calibrated correctly).

In PLAYING state 1020, the device plays back the drum beat, guitar input is passed through unprocessed to AMP OUT (if connected), or Left/Right Mixer output jacks, if not. In PLAYING state 1020, footswitch taps may change the part of a drum pattern being played, from verse, to chorus, to one or more fills. A long hold of the footswitch will turn to OUTRO state 1025 (learn LED is off and Play LED is lit green, Part LED flashes and PADS flash). By releasing the footswitch, the device enters STOPPED state 1030 (learn LED is off and Play LED is dim green). In STOPPED state 1030 the device is not playing back but a part is loaded (PLAY LED is dim green), guitar input is passed through unprocessed to AMP OUT (if connected), or Left/Right Mixer output jacks, if not.

Tapping the control switch from STOPPED state 1030 can return the device to PLAYING state 1020. Alternatively, one or more parts of a song may be cleared from STOPPED state 1030. For example, a long hold on the control switch may clear part of a song, or a very long hold may clear the entire song either of which trigger SONG/PART CLEARED state 1015. From SONG/PART CLEARED state 1015 a long hold or undo command can return to STOPPED state 1030. Alternatively a tap of the control switch from SONG/PART CLEARED state 1015 can trigger READY TO LEARN state 1005.

FIG. 10 also depicts CALIBRATE state 1035 (learn LED is off and Play LED is off, one or more of Kick/Snare and style LEDs are used to show progress of a calibration mode. A calibration state is entered at any time by pressing and holding the Guitar Audition button. In this state, the GUITAR OUT signal will be muted. The player will start the calibration process by muting his strings and scratching across the low strings. Each time the device detects an event, it will turn off the next Hats/Rides LED. When 12 events are detected, the Snare LED will then flash rapidly and the Kick LED will be off. All Hats/Rides LEDs will now be red. The process is then repeated for the high scratches to calibration the snare. When the 12th snare event has been detected, the Guitar Audition LED will turn on and the user will hear kick and snare beats played according to his scratches. Any UI event (button or footswitch press) during calibration cancels calibration and returns the pedal to the cleared state.

While this disclosure has been particularly shown and described with references to exemplary embodiments thereof, it will be understood by those skilled in the art that various changes in form and details may be made therein without departing from the scope of the claimed embodiments.

What is claimed is:

1. A method for generating a drum pattern, the method comprising:

receiving a user generated input including a plurality of events during a time interval;

detecting the plurality of events in the user generated input, wherein a first classification is performed at a first latency for playback of a drum sample and a second classification is performed at a second latency;

outputting a sound element for each detected event as feedback based on the first classification in response to an event;

analyzing the plurality of events based on the second classification performed at the second latency to define a rhythmic pattern based on number of events detected, placement of each event in the time interval, and duration of the time interval, wherein analyzing includes classifying each of the plurality of events into at least one type of drum pattern element; and generating a drum pattern based on the rhythmic pattern, wherein the drum pattern includes a drum element for each event of the rhythmic pattern.

2. The method of claim 1, wherein the user generated input is an audio signal received from at least one of a musical instrument and microphone, the audio signal indicating a desired groove for the drum pattern.

3. The method of claim 1, wherein the user generated input is a percussive beat tapped as input to a device, the percussive beat indicating a desired groove for the drum pattern.

4. The method of claim 1, wherein detecting the plurality of events includes detecting at least one feature for each event from an audio input signal received as the user generated input.

5. The method of claim 1, wherein detecting the plurality of events includes detecting an input activation of a device for each event, wherein the input activation is relative to at least one input control element of the device.

6. The method of claim 1, wherein analyzing includes determining a number of bars, time signature and feel for the rhythmic pattern.

7. The method of claim 1, wherein classifying each of the plurality of events into at least one type of drum pattern element includes classifying each event as one of a kick drum element and snare drum element.

8. The method of claim 1, wherein the rhythmic pattern provides an arrangement of drum beats relative to a determined number of bars, determined time signature and determined feel for the plurality of events.

9. The method of claim 1, further comprising outputting a sound element for each detected event, wherein the sound element is output within a time period in the range of about 10-30 milliseconds from detection of the event.

10. The method of claim 1, further comprising determining event placement with respect to a beat characterization for the time interval and beat subdivisions.

11. A device comprising:

an input configured to receive user generated input; and a control unit coupled to the input, the control unit configured to receive user generated input including a plurality of events during a time interval;

detect the plurality of events in the user generated input, wherein a first classification is performed at a first latency for playback of a drum sample and a second classification is performed at a second latency;

output a sound element for each detected event as feedback based on the first classification in response to an event;

analyze the plurality of events based on the second classification performed at the second latency to define a rhythmic pattern based on number of events detected, placement of each event in the time interval, and duration of the time interval, wherein analyzing includes classifying each of the plurality of events into at least one type of drum pattern element; and generate a drum pattern based on the rhythmic pattern, wherein the drum pattern includes a drum element for each event of the rhythmic pattern.

12. The device of claim 11, wherein the user generated input is an audio signal received from at least one of a musical instrument and microphone, the audio signal indicating a desired groove for the drum pattern.

13. The device of claim 11, wherein the user generated input is a percussive beat tapped as input to a device, the percussive beat indicating a desired groove for the drum pattern.

14. The device of claim 11, wherein detecting the plurality of events includes detecting at least one feature value for each event from an audio input signal received as the user generated input.

15. The device of claim 11, wherein detecting the plurality of events includes detecting an input activation of a device for each event, wherein the input activation is relative to at least one input control element of the device.

16. The device of claim 11, wherein analyzing includes determining a number of bars, time signature and feel for the rhythmic pattern.

17. The device of claim 11, wherein classifying each of the plurality of events into at least one type of drum pattern element includes classifying each event as one of a kick drum element and snare drum element.

18. The device of claim 11, wherein the rhythmic pattern provides an arrangement of drum beats relative to a determined number of bars, determined time signature and determined feel for the plurality of events.

19. The device of claim 11, further comprising outputting a sound element for each detected event, wherein the sound element is output within a time period in the range of about 10-30 milliseconds from detection of the event.

20. The device of claim 11, further comprising determining event placement with respect to a beat characterization for the time interval and beat subdivisions.

* * * * *